US006200236B1

(12) United States Patent
Minami et al.

(10) Patent No.: US 6,200,236 B1
(45) Date of Patent: Mar. 13, 2001

(54) TABLE TENNIS APPARATUS

(75) Inventors: Kojiro Minami, Kobe; Toshimitsu Oishi, Akashi; Akihisa Yamashita, Kobe; Hideki Kotani, Kobe; Hirofumi Fujimoto, Kobe; Katsunori Hirasawa, Kobe, all of (JP)

(73) Assignee: Konami Co., Ltd., Hyogo-ken (JP)

( * ) Notice: Subject to any disclaimer, the term of this patent is extended or adjusted under 35 U.S.C. 154(b) by 0 days.

(21) Appl. No.: 09/149,668

(22) Filed: Sep. 9, 1998

(30) Foreign Application Priority Data

Sep. 17, 1997 (JP) ..... 9-272149

(51) Int. Cl.[7] ..... A63B 67/04; A63B 71/04

(52) U.S. Cl. ..... 473/496; 124/78; 273/108

(58) Field of Search ..... 473/496, 475, 473/431; 124/78; 273/108, 108.1, 108.31, 108.32

(56) References Cited

U.S. PATENT DOCUMENTS 3,995,859 * 12/1976 Goldfarb et al. ..... 273/317.5
3,999,754 * 12/1976 Krzysztofiak et al. ..... 473/431
4,002,336 1/1977 Beaver et al. .
4,442,823 * 4/1984 Floyd et al. ..... 124/78
5,566,936 * 10/1996 Newgarden et al. ..... 473/475

FOREIGN PATENT DOCUMENTS 3017687 8/1995 (JP) .

* cited by examiner

*Primary Examiner*—Jeanette Chapman
*Assistant Examiner*—M. Chambers
(74) *Attorney, Agent, or Firm*—Jordan and Hamburg LLP

(57) ABSTRACT

A table tennis apparatus includes a ball projecting section disposed rearward of one playing surface of a table for projecting balls towards the other playing surface, a moving mechanism for allowing ball projecting section to be moved laterally, a detecting unit for detecting which side the balls have dropped on one playing surface in the lateral direction, and a driving and controlling unit for driving the moving mechanism according to the drop positions of the balls detected by the detecting unit, and for moving the ball projecting section towards the drop positions of the balls. The moving mechanism includes a guide rail disposed along a lateral direction, and a base having the ball projecting section mounted thereon, and slidably disposed on the guide rail.

9 Claims, 21 Drawing Sheets

TABLE TENNIS APPARATUS

BACKGROUND OF THE INVENTION

1. Field of the Invention

The present invention relates to a table tennis apparatus for projecting table tennis balls towards one playing surface on the side of a player from a ball projecting section disposed rearward of the other playing surface of a table.

2. Description of the Related Art

Hitherto, a table tennis apparatus of this type, for example, as disclosed in Japanese Utility Model Registration No. 3017687 has been proposed. Such a conventional table tennis apparatus includes a table having a net stretched on the center thereof, a ball projecting section that is disposed on the rearward of one playing surface (a playing surface on the side of a machine) and that projects table tennis balls sequentially towards the other surface (a playing surface on the side of a player), wherein a plurality of optical sensors each having a light emitting element and a light receiving element are opposingly arranged on the left and right of the playing surface on the machine side along a longitudinal direction thereof, while a drop position of the ball returned by the player on the machine-side playing surface is detected by the optical sensors, and a score corresponding to the position is given to the player, the result of a training thereby being displayed by a specific numeral value.

The above conventional table tennis apparatus includes the ball projecting section disposed at the center position in the lateral direction relative to the playing surface, and an oscillating mechanism, so that balls can be aimed at both corners of the table, in addition to being straight in the longitudinal direction, thus enabling high-level training.

The construction of the ball projecting section of the table tennis apparatus is disclosed in, for example, Japanese Patent Publication No. 58-22229 and Japanese Utility Model Publication No. 63-7264.

According to the above conventional table tennis apparatus, since the ball projecting section is fixed to the center position in the lateral direction relative to the playing surface on the machine side, balls can simply be delivered by the oscillating mechanism from the center position to the left and right of the playing surface on the player side, and only a drop position of the ball on the playing surface on the machine side in the longitudinal direction is detected by the optical sensors to give a predetermined score to the player. Therefore, various modes of actual competitive play cannot be reproduced, resulting in limited applicability to training which is in touch with actual competitive play and to a table tennis game.

SUMMARY OF THE INVENTION

Accordingly, it is an object of the present invention to provide a table tennis apparatus which can enhance the result of training by making it possible to realize a mode which is closer to actual competitive play, and which is suitable for a table tennis game.

According to an aspect of the present invention, there is provided a table tennis apparatus including a ball projecting section disposed rearward of a table for projecting balls towards a playing surface on the side of a player; a moving mechanism for allowing the ball projecting section to be moved laterally; a detecting unit for detecting which side the balls have been returned in the lateral direction; and a driving and controlling unit for driving the moving mechanism according to the direction detected by the detecting unit in which the balls have been returned, and for moving the ball projecting section to the side where the balls have been returned.

With the described arrangements, balls are projected from the ball projecting section disposed rearward of the table towards the playing surface on the player side, and the lateral direction of the ball returned from the player side is detected by the detecting unit. The moving mechanism is actuated according to the direction detected by the detecting unit, and the ball projecting section is moved laterally. Therefore, a mode which is closer to actual competitive play can be realized. In addition, it is possible to efficiently enhance the result of training when the table tennis apparatus of the present invention is used for training of table tennis. Furthermore, the table tennis apparatus becomes very interesting when used for a table tennis game.

In the table tennis apparatus of the present invention, the table may include a playing surface on the side of a machine, and the ball projecting section may be disposed rearward of the playing surface on the side of the machine.

With the described arrangements, balls are projected from the ball projecting section disposed rearward of the playing surface on the machine side. Therefore, it is possible to realize a mode which is further closer to actual competitive play.

In the table tennis apparatus of the present invention, the moving mechanism may include a guide rail disposed along a lateral direction, and a base having the ball projecting section mounted thereon, and slidably disposed on the guide rail.

With the described arrangement, the ball projecting section can be moved with a simple construction according to a drop position of the ball.

In the table tennis apparatus of the present invention, the driving and controlling unit allows the ball projecting section to be moved in the direction of at least three predetermined positions at the center, left, and right in the lateral direction.

With the described arrangement, the ball projecting section may be moved by the driving and controlling unit in the direction of at least three predetermined positions at the center, left, and right in the lateral direction, so that a mode which is further closer to actual competitive play can be realized.

In the table tennis apparatus of the present invention, the driving and controlling unit may include a sensor for detecting the location of the ball projecting section on the center position.

With the described arrangement, the ball projecting section can be positively returned to the center position even if it is moved leftward or rightward.

In the table tennis apparatus of the present invention, the ball projecting section may include an oscillating mechanism.

With the described arrangement, it is possible to project balls towards both corners of the table, in addition to being straight in the longitudinal direction.

In the table tennis apparatus of the present invention, a ball hopper may be disposed above said ball projecting section, and the ball hopper and the ball projecting section may be connected by a flexible tube having a diameter that is capable of having balls passed therethrough.

With the described arrangements, it is possible to move only the ball projecting section with the ball hopper held fixed, thereby simplifying the construction of the moving mechanism.

DESCRIPTION OF THE PREFERRED EMBODIMENT

Figure 1:
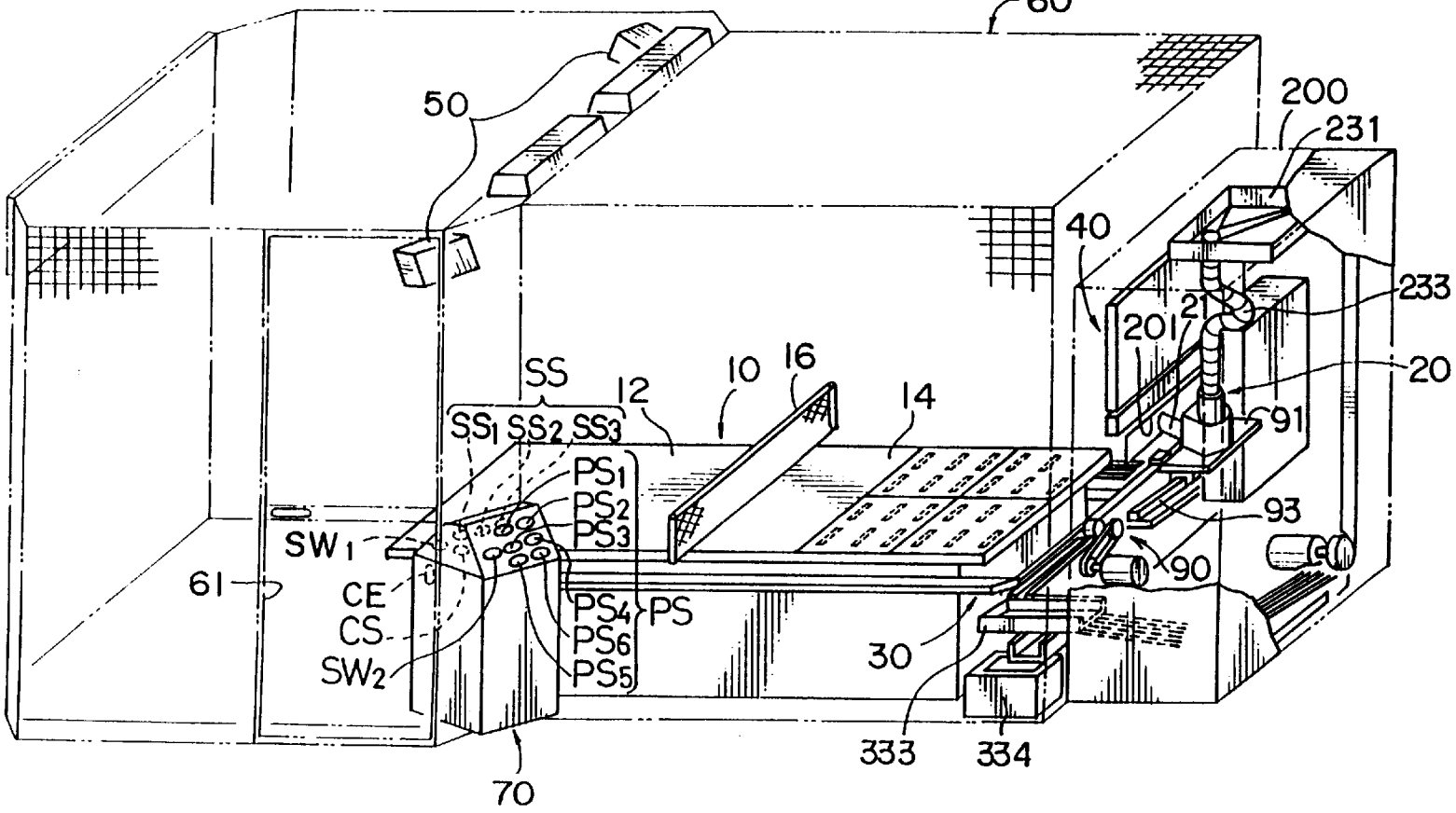
FIG. 1 is an external perspective view which schematically illustrates a construction of a table tennis apparatus according to an embodiment of the present invention.

Referring to FIG. 1, a table tennis apparatus includes a table 10, a ball projecting section 20 for projecting balls towards a player's playing surface, a ball collecting section 30 for collecting balls dropped on a floor or the like, a display section 40 for displaying scores and a demonstration picture, a sound section 50 for outputting presentation music and sound effects, a box 60 for surrounding the table 10, a control box 70 for setting various types of game (training) modes and the like, a control section 80 (FIG. 12) for controlling the overall operations of the apparatus, and a moving mechanism 90 for moving the ball projecting section 20 laterally. In this embodiment, the direction between both end lines of the table 10 is referred to as a longitudinal direction, while the direction between both side lines of the table 10 is referred to as a lateral direction from the point of view of the player. However, it is not necessary to actually provide the end lines and sidelines on the table 10 of the table tennis apparatus according to the present invention.

The table 10 includes a player's playing surface 12, a playing surface 14 on the side of which the ball projecting section 20 is disposed, and a net 16 that is disposed between the playing surfaces 12 and 14 and stretched to have a predetermined height. As shown in detail in FIG. 2, the playing surface 14 includes a frame structure 141 and a plate body 142 formed by, for example, white semi-transparent resin for covering the top of the frame structure 141.

The frame structure 141 is separated into a plurality of areas by lateral partition walls 148 and 149, and a longitudinal partition wall 150. That is, the frame structure 141 divides the playing surface 14 into almost three equal parts in the longitudinal direction to form a front area (a first area 143), a center area and a rear area. The center area is divided into two equal parts in the lateral direction to form a right-side second area 144 and a left-side third area 145, and the rear area is divided into two equal parts to form a right-side fourth area 146 and a left-side fifth area 147.

A plurality of green-luminary cold-cathode tubes 181 are disposed in the second area 141, and a plurality of blue-luminary cold-cathode tubes 182 are disposed in the third area 145. In addition, a plurality of red-luminary cold-cathode tubes 183 are disposed in the fourth area 146, and a plurality of yellow-luminary cold-cathode tubes are disposed in the fifth area 147. Color bulbs lit up by the passage of electric current through filaments may be used in place of the above cold-cathode tubes 181 to 184. In the present invention, the cold-cathode tubes and bulbs are named generically as lamps.

The semi-transparent plate body 142 serves as a surface illuminant for each color light emitted from each cold-cathode tube, and as a diaphragm that is vibrated by a ball drop impact. The plate body 142 consists of a first plate 151, a second plate 152, a third plate 153, a fourth plate 154 and a fifth plate 155 that correspond to the areas 143, 144, 145, 146 and 147, respectively. The first to fifth plates 151 to 155 form first to fifth areas E1 to E5, respectively, of the playing surface 14. The plate body 142 has lateral grooves 156 and 157, and a longitudinal groove 158 formed in the lower surfaces of the boundaries of the plates 151 to 155, while uses the plates 151 to 155 as surface illuminants, thereby obtaining an illumination effect.

The first plate 151 has a pair of microphones 190 and 191 disposed on the lower surface thereof in the vicinity of diagonal positions, the second plate 152 has a pair of microphones 192 and 193 disposed on the lower surface thereof in the vicinity of diagonal positions, and the third plate 153 has a pair of microphones 194 and 195 disposed on the lower surface thereof in the vicinity of diagonal positions. In addition, the fourth plate 154 has a pair of microphones 196 and 197 disposed on the lower surface thereof in the vicinity of diagonal positions, and the fifth plate 155 has a pair of microphones 198 and 199 disposed on the lower surface thereof in the vicinity of diagonal positions.

Each of the microphones 190 to 199 serves as a vibration sensor, and detects onto which of the first to fifth plates 151 to 155 a ball has dropped. For example, when the ball drops onto the second plate 152, a vibration radially propagates from the drop point to the periphery of the plate 152 while being damped, and the vibration is detected by the microphones 192 and 193. While the vibration is also detected by the microphones of other plates, the plate onto which the ball has dropped can be defined from the difference in detection levels, a time lag of the propagation of the vibration, and so forth. In particular, since the grooves 156 to 158 are provided in the plate body 142, the vibration is abruptly damped at the grooves, thereby preventing a wrong detection of the vibration. A detection signal output from each of the microphones 190 to 199 is input to a control section 30 and used for score handling or the like.

The grooves 156 to 158 are not necessary to detect the drop position of the ball, and the plate body 142 may have the plates 151 to 155 formed by individual members. When the plates 151 to 155 are formed by individual members, a member, such as a rubber, for preventing the propagation of the vibration may preferably be provided in a gap formed between each of the adjacent members, and a member, such as a rubber, for preventing the propagation of the vibration may preferably be disposed on a boundary of each of the plates so that each of the plates are provided on the member with a small gap formed therebetween. In addition, the plate body 142 and the microphones 190 to 199 constitutes a detection unit for detecting a drop position of the ball returned back from the player. In this embodiment, one or a plurality of areas E2 to E5 of the playing surface 14 is illuminated to recommend to the player that the ball be returned the illuminating areas so that the player can obtain a score higher than that obtained by the returning it to the non-illuminating areas when the return of the ball on the illuminating area is detected by the microphones. It should be appreciated that a score may be given to the player when returning the ball only to the illuminating areas.

The ball projecting section 20 is disposed on the rear of the playing surface 14 with almost the entire thereof accommodated in a casing 200.

Figure 3:
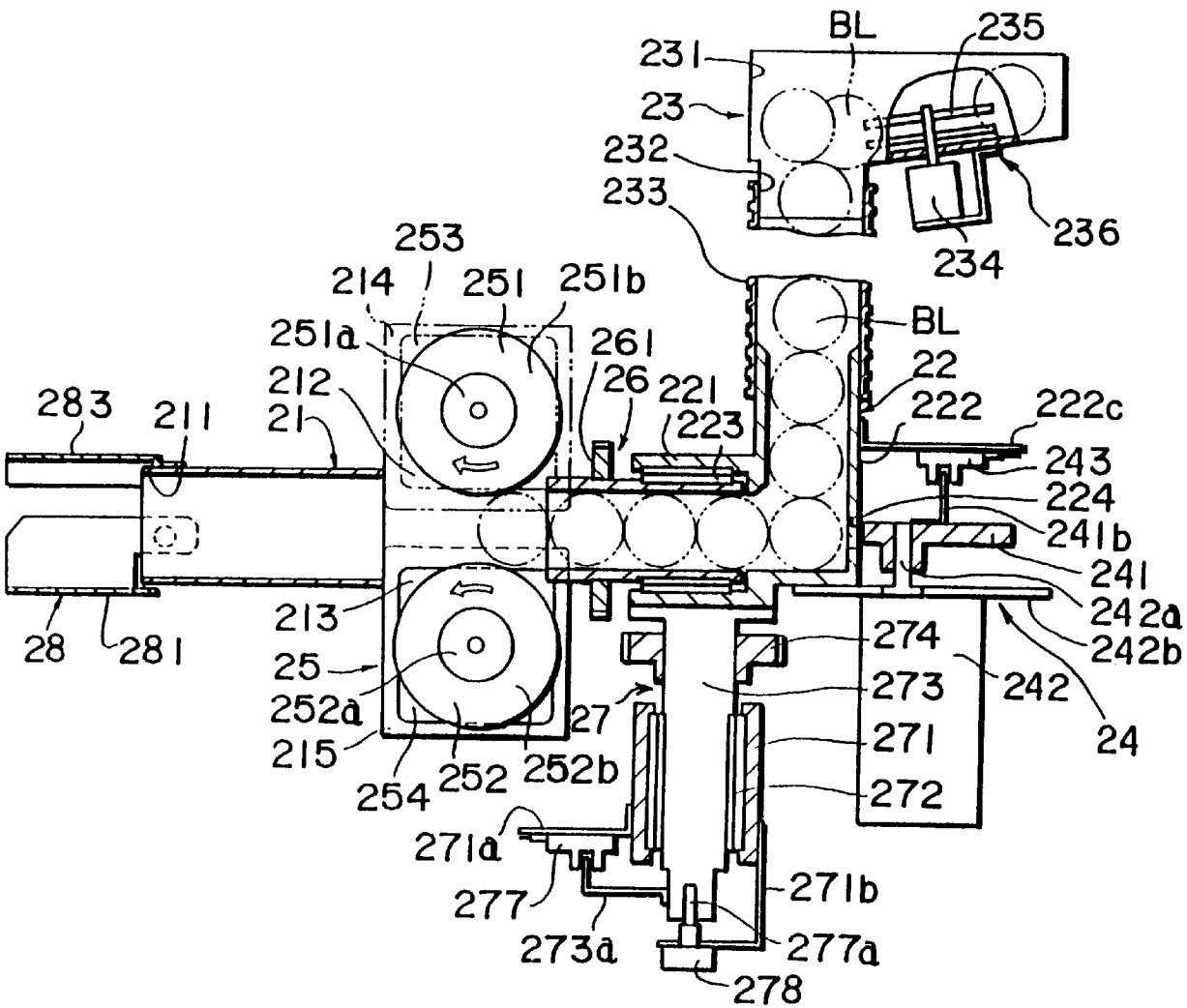
FIG. 3 is a vertical sectional view showing a construction of a ball projecting section in the table tennis apparatus shown in FIG. 1.
Figure 4:
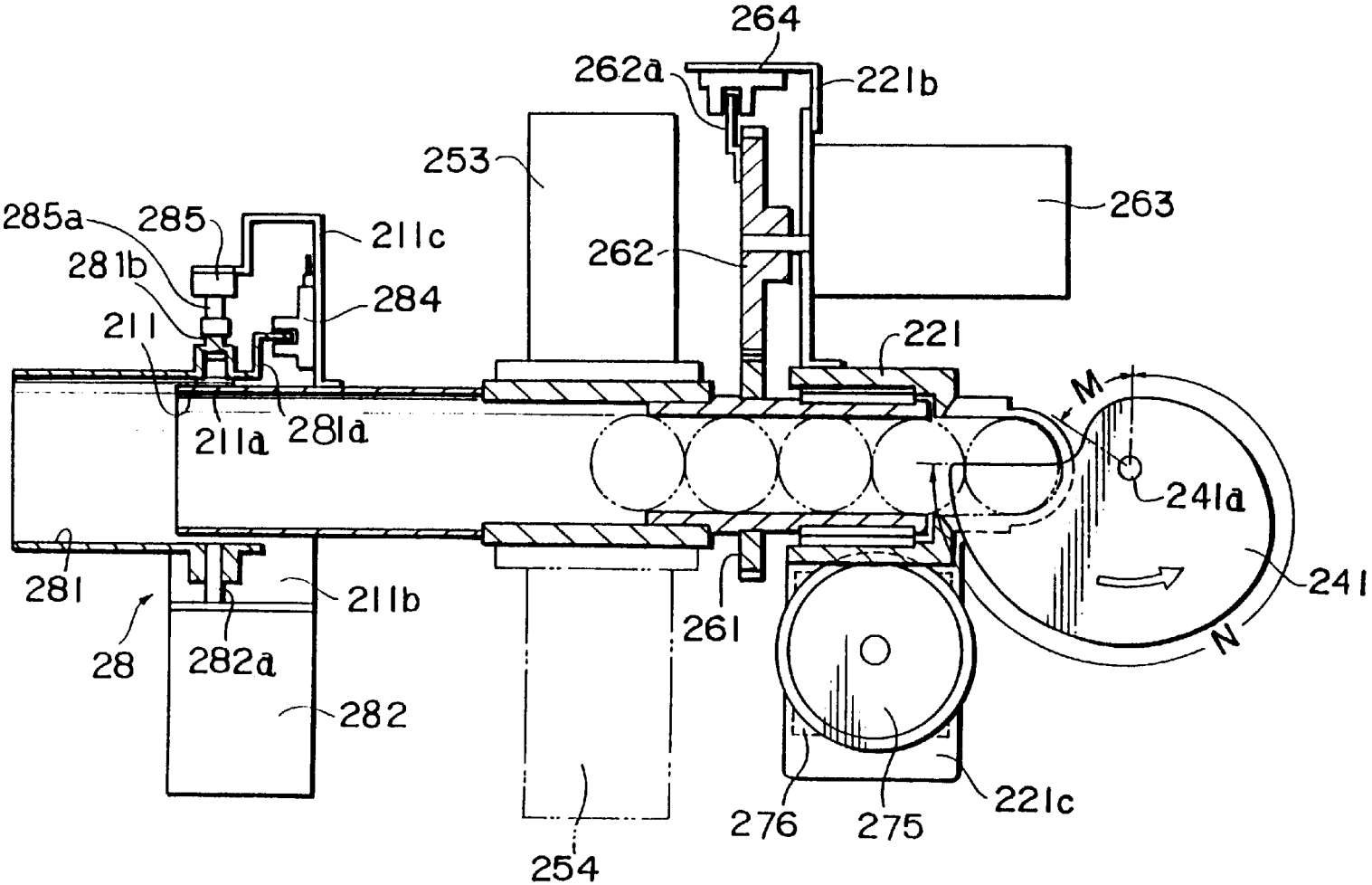
FIG. 4 is a transverse sectional view showing a construction of the ball projecting section in the table tennis apparatus shown in FIG. 1.

Referring to FIGS. 3 and 4, the ball projecting section 20 includes a ball projecting cylinder 21 for projecting table tennis balls from one end thereof, a ball feeding cylinder 22 for feeding the balls to the ball projecting cylinder 21, a ball supply section 23 for supplying the balls to the ball feeding cylinder, a ball dispensing unit 24 for dispensing balls one at a time from the ball feeding cylinder 22, an urging force-imparting unit 25 for imparting an urging force in the direction of projection to the ball dispensed to the ball projecting cylinder 21, a rotary unit 26 for rotating the ball projecting cylinder 21 around the axis thereof to change the type of projection of ball (such as curved ball, straight ball, etc.) an oscillating mechanism 27 for swinging the ball projecting cylinder 21 in the lateral direction of the table 10 to change the projecting direction of the ball, and an angle changing unit 28 for changing an angle of the ball in a direction of elevation.

The ball projecting cylinder 21 is disposed so as to be directed slightly diagonally upward with a projecting port 211 projected to the outside from an oblong window 201, and projects the ball urged by the urging force-imparting unit 25 from the projecting port 211 towards the playing surface 12. In addition, cutouts 212 and 213 into which a pair of rollers 251 and 252, which are described later, partially enter are formed at opposite positions of an intermediate portion of the ball projecting cylinder 21.

The ball feeding cylinder 22 is provided in the casing 200, and has an L-shape consisting of a horizontal part 221 and a vertical part 222, and the horizontal part 221 is fitted to the rear end outer periphery of the ball projecting cylinder 21 through a ball bearing 223. This allows the ball projecting cylinder 21 to be rotated around the axis thereof. In addition, an opening 224 is formed at the rear of the lower end of the vertical part 222 into which a plate cam 241, which is described later, of the ball dispensing unit 24 partially enters.

The ball supply section 23 is disposed above the ball projecting section 20, which can be moved laterally by a moving mechanism 90 to be described later, and is fixed on the upper part in the casing 200. The ball supply section 23 includes a ball hopper 231 for containing a plurality of balls, and a flexible tube 233 that is connected to a supply port 232 formed on the bottom of the hopper 231 and the vertical part of the ball feeding cylinder 22. The hopper 231 includes a ball stirring unit 236 consisting of an external-mounted hopper-inside stirring motor 234, and a stirring bar 235 having, for example, elasticity disposed inside thereof. The stirring bar 235 is rotationally driven by the motor 234, whereby a jam of the ball BL at the supply port 232 is prevented.

The ball dispensing unit 24 consists of a plate cam 241, and a plate cam motor 242 for rotationally driving the plate cam 241. The plate cam 241 is integrally fixed to a perpendicular rotary shaft 242*a* of the plate cam motor 242 at the rear position of the ball feeding cylinder 22. The plate cam 241 consists of a small diameter part M and a cam part N of which the diameter gradually increases in the direction of rotation. The small diameter part M has a diameter so as not to enter into the ball feeding cylinder 22, and one side of the cam part N adjacent to the small diameter part M has a small diameter size and the other side has a large diameter size of at least one table tennis ball. The direction of the plate cam 241 is reversed in FIGS. 3 and 4 for reasons of explanation.

The plate cam motor 242 is fixed upward to a motor mounting plate 222*b* fitted on the bottom of the vertical part 222. The plate cam motor 242 is rotated to rotate the plate cam 241 once in the direction shown by the arrow in FIG. 4, whereby the balls fed to the lower end of the vertical part 222 are dispensed one at a time towards the horizontal part 221. That is, when the small diameter part M of the plate cam 241 starts to rotate at the position (initial position) opposite to the ball feeding cylinder 22, the ball fed to the lower end of the vertical part 222 is abutted against the cam part N and dispensed to the horizontal part 221.

A shielding plate 241*b* in an upright position is fixed on the plate cam 241 at a position apart from the rotary shaft 242*a*. On the other hand, a plate cam sensor 243 consisting of a photo-interrupter is fixed to a sensor mounting plate 222*c* provided above the plate cam 241. In the plate cam sensor 243, the positions of a light emitting element and a light receiving element are set so that the shielding plate 241*b* can pass through a gap formed therebetween. This allows the initial position of the plate cam 241 to be detected when the shielding plate 241*b* interrupts between the light emitting element and the light receiving element of the plate cam sensor 243, so that the number of rotation of the plate cam 241 is counted each time the initial position is detected.

The urging force-imparting unit 25 includes a pair of rollers 251 and 252 disposed so that they are opposite to each other, and a pair of roller motors (DC motors) 253 and 254 for individually rotationally driving the rollers 251 and 252. The rollers 251 and 252 are constructed by arranging rubber members 251*b* and 252*b* on the outer periphery of metallic members 251*a* and 251*a,* and partially enter into the cutouts 212 and 213. The roller motors 253 and 254 are fixed to motor mounting plates 214 and 215, respectively. By the described arrangement, the rollers 251 and 252 are rotated in the directions shown by the arrows with sandwiching of the ball BL from both sides when the ball projecting cylinder 21 rotates around the axis thereof together with the roller motors 253 and 254, thereby imparting an urging force in the projecting direction (forward direction) to the ball BL. The rollers 251 and 252 can impart a projecting speed to the ball corresponding to the peripheral speed thereof, and can apply a spin on the ball projected from the ball projecting cylinder 21 because of the impartment of a difference in the peripheral speed.

In other words, a top spin (drive) can be applied on the ball when the peripheral speed of the roller 251 is increased to relatively faster than the peripheral speed of the roller 252. Conversely, a back spin can be applied on the ball when the peripheral speed of the roller 252 is increased to relatively faster than the peripheral speed of the roller 251. In addition, when the peripheral speeds of the rollers 251 and 252 are substantially equalized, almost no rotating force is applied to the ball, and a so-called knuckle ball can be obtained. Furthermore, if a difference in peripheral speed is imparted to the rollers 251 and 252 in a state where the ball projecting cylinder 21 is rotated around the axis thereof, and the rollers 251 and 252 are tilted, it is possible to obtain a ball on which a side spin is applied.

The rotary unit 26 includes a follower gear 261 attached to the rear end outer periphery of the ball projecting cylinder 21, a drive gear 262 meshed with the follower gear 261, and a projecting cylinder motor 263 for rotationally driving the drive gear 262. The motor 263 is fixed to a motor mounting plate 221*a* attached to the horizontal part 221 of the ball feeding cylinder 22. The motor 263 rotates in both normal and reverse directions, whereby the ball projecting cylinder 21 is rotated around the axis thereof.

A radially extending shielding plate 262*a* is fixed to the side surface of the drive gear 262. On the other hand, a sensor mounting plate 221*b* is attached to the motor mounting plate 221*a,* and a rotation sensor 264 consisting of a photo-interrupter is fixed to the sensor mounting plate 221*b*. In the rotation sensor 264, the positions of a light emitting element and a light receiving element are set so that the shielding plate 262*a* can pass through a gap formed therebetween. This allows the initial position of the ball projecting cylinder 21 around the axis thereof to be detected when the shielding plate 262*a* interrupts between the light emitting element and the light receiving element of the rotation sensor 264. A state where the rollers 251 and 252 are vertically positioned is regarded as the initial position of the ball projecting cylinder 21. In this embodiment, the ball projecting cylinder 21 rotates both rightward and leftward based on the initial position within a range of 45°.

The oscillating mechanism 27 includes a cylindrical strut 271 fixed to a base 91 (see FIG. 5), a rotary shaft 273 which is fixed to the bottom of the horizontal part 221, and is mounted in the strut 271 through a ball bearing 272, a follower gear 274 fixed to the upper portion of the rotary shaft 273, a drive gear 275 meshed with the follower gear 274, and a projecting section oscillating motor 276 for rotationally driving the drive gear 275. The motor 276 is fixed to a motor mounting plate 221*c* attached to the vertical part 222 of the ball feeding cylinder 22. The motor 276 rotates in both normal and reverse directions, whereby the ball projecting section 20 is laterally rotated around the rotary shaft 273 to effect oscillating. By the described arrangement, a straight ball can be projected when the ball projecting section 20 is located laterally, and the ball can be projected aiming at both corners of the table 10 when the ball projecting section 20 is located in a slanting position. That is, the balls can be projected in a crosswise direction in addition to a straight direction by the oscillating mechanism 27.

A shielding plate 273*a* of which one end is directed upward is attached to the lower end of the rotary shaft 273. A sensor mounting plate 271*a* is attached to the front outer periphery of the lower end of the strut 271, and a rotation sensor 277 consisting of a photo-interrupter is fixed to the sensor mounting plate 271*a*. In the rotation sensor 277, the positions of a light emitting element and a light receiving element are set so that the shielding plate 273*a* can pass through a gap formed therebetween. This allows the initial position of the ball projecting section 20 in the direction of rotation around the rotary shaft 273 to be detected when the shielding plate 273*a* interrupts between the light emitting element and the light receiving element of the rotation sensor 277. A direction straight along the longitudinal direction of the table 10 is regarded as the initial position of the ball projecting section 20.

A sensor mounting plate 271*b* is attached to the rear outer periphery of the lower end of the strut 271, and an oscillating angle sensor 278 consisting of a variable resistor is attached to the sensor mounting plate 271*b*. A rotary shaft element 277*a* of the oscillating angle sensor 278 is coaxially fixed to the rotary shaft 273 of the oscillating mechanism 27. By the above arrangement, the oscillating angle of the ball projecting section 20 is detected by a voltage value output from the sensor 278 according to the amount of rotation of the rotary shaft 273, so that the oscillating angle of the ball projecting section 20 is controlled based on the initial position thereof.

The angle changing unit 28 includes a guide plate 281 rotatably and forward-projectingly attached to the periphery of the projecting port 211, and a guide plate motor 282 for rotating the guide plate 281 in a direction to interrupt the course of the ball projected from the projecting port 211 (i.e., a direction to cross the projecting direction). Both base ends of the guide plate 281 are journaled at opposite positions of the outer periphery of the proximal end of the projecting port 211 when the ball projecting cylinder 21 is in the initial position around the axis thereof. That is, one base end is journaled by a projection 211*a,* and the other base end is journaled by a rotary shaft 282*a* of the guide plate motor 282 fixed to the motor mounting plate 211*b* which is fitted to a suitable position of the outer periphery of the projecting port 211.

By the described arrangement, when the ball projecting cylinder 21 is in the initial position around the axis thereof, the guide plate motor 282 is rotated by a predetermined amount to rotate the guide plate 281, whereby the projecting direction of the ball can be changed to be directed diagonally upward (i.e., the projection angle of the ball can be changed). That is, the ball at the projecting port 211 abuts against the guide plate 281 to be directed upward, so that it is possible to project the ball in a path describing a parabola. The shape of the parabola can be controlled by the amount of rotation (elevation angle) of the guide plate 281 and the ball-projecting speed. An angle control plate 283 is disposed on the opposite side of the guide plate 281 along the axial direction of the ball projecting cylinder 21. By the described arrangement, when the projecting angle of a fast ball is greatly changed by the guide plate 281, the ball comes into contact with the angle control plate so that the shape of the parabola can be controlled and it becomes difficult for the ball to go over the playing surface 12.

A shielding plate 281*a* is attached on the base end of the guide plate 281 so as to extend rearward. On the other hand, a sensor mounting plate 211*c* is attached in the vicinity of the projecting port 211, and a guide plate sensor 284 consisting of a photo-interrupter is fixed to the sensor mounting plate 211*c*. In the guide plate sensor 284, the positions of a light emitting element and a light receiving element are set so that the shielding plate 281*a* can pass through a gap formed therebetween. This allows the initial position of the guide plate 281 to be detected when the shielding plate 281*a* interrupts between the light emitting element and the light receiving element of the guide plate sensor 284. A direction along the axial direction of the ball projecting cylinder 21 is regarded as the initial position of the guide plate 281.

A projecting angle sensor 285 consisting of a variable resistor is attached to the sensor mounting plate 211*c,* and a rotary shaft element 285*a* of the sensor 285 is fixed to a projection 281*b* of the guide plate 281 that is coaxially fixed to a projection 211*a*. By the above arrangement, the amount of rotation of the guide plate 281 is detected by a voltage value output from the sensor 285, so that the ball projecting angle is controlled based on the initial position thereof.

Figure 5:
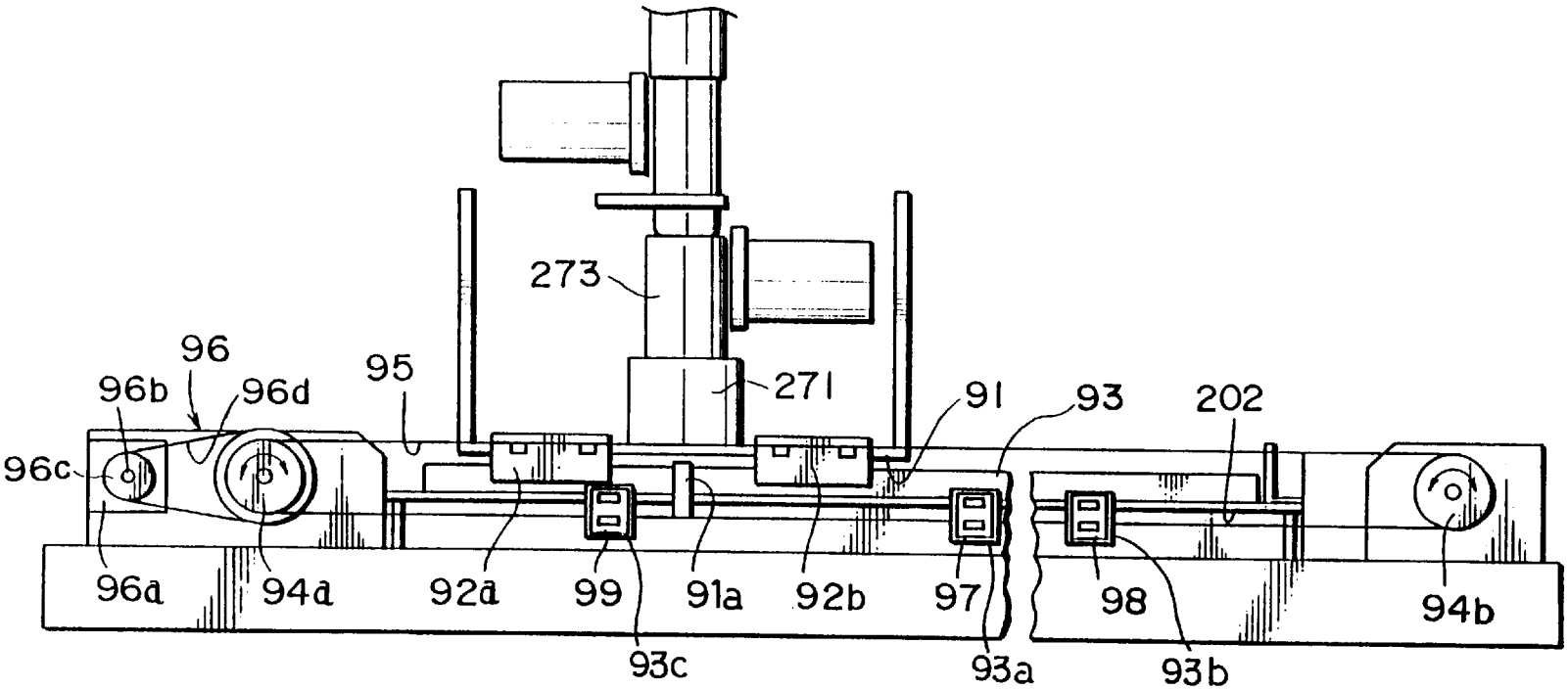
FIG. 5 is a rear elevation showing a construction of a moving mechanism for the ball projecting section in the table tennis apparatus shown in FIG. 1.
Figure 6:
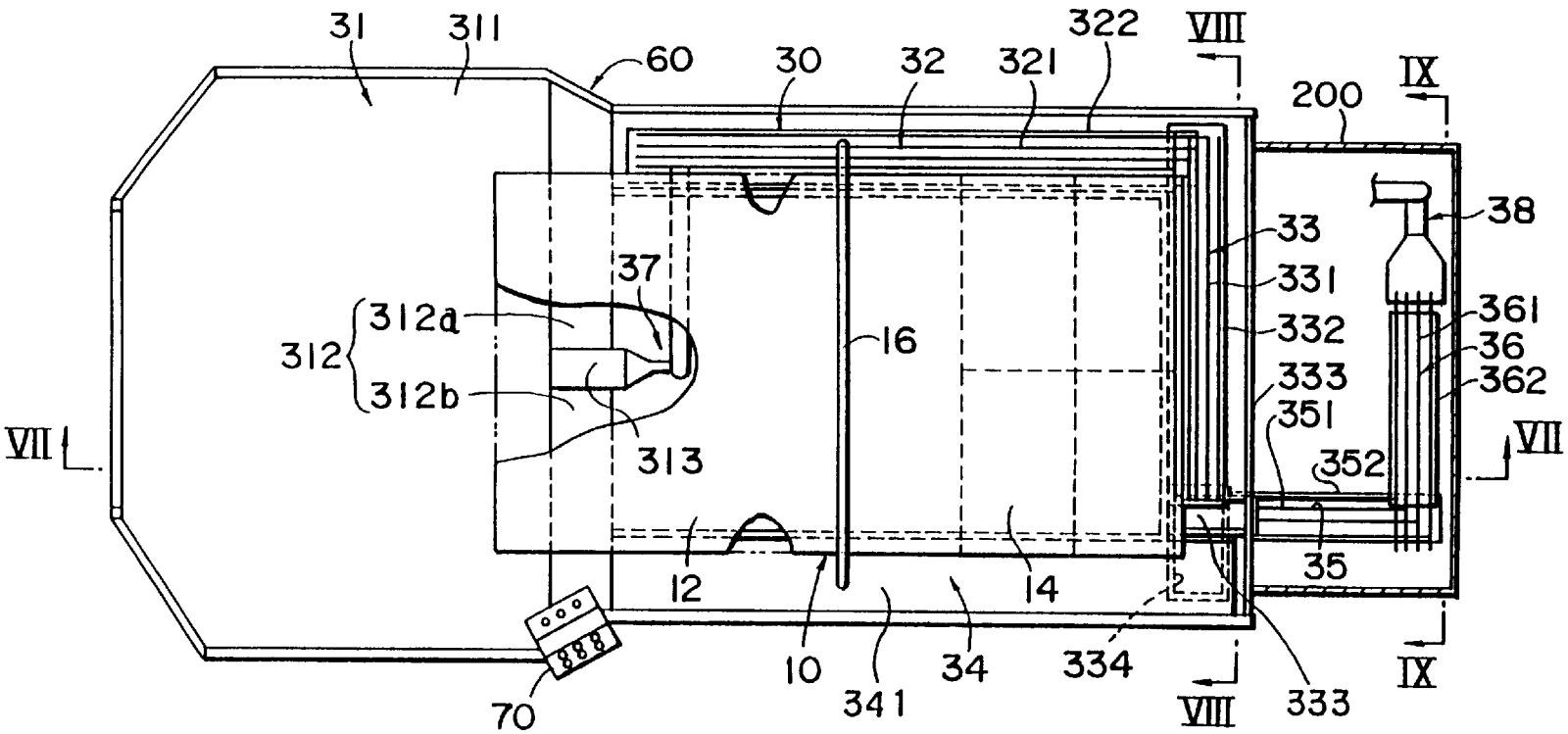
FIG. 6 is a plan view showing a construction of a ball collecting section in the table tennis apparatus shown in FIG. 1.
Figure 7:
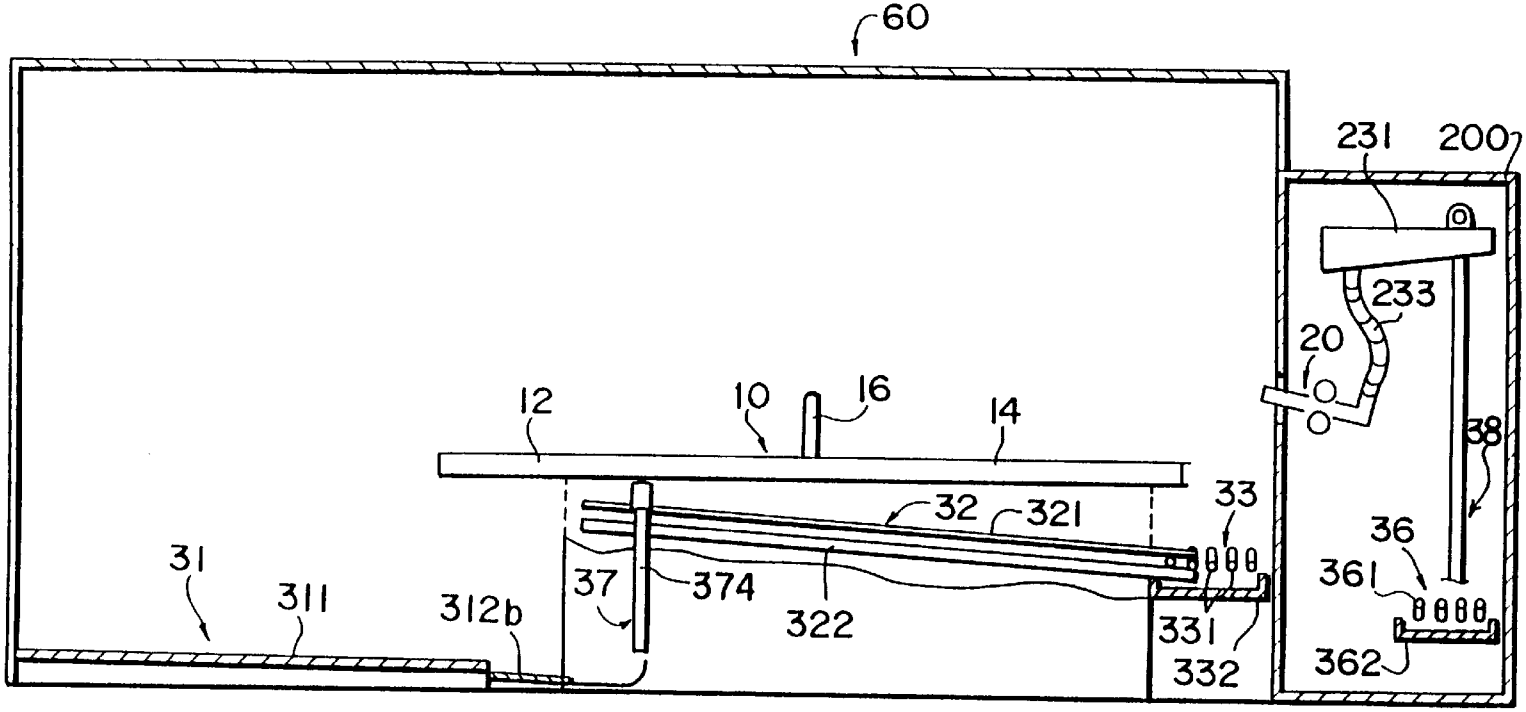
FIG. 7 is a sectional view taken along line VII—VII of FIG. 6.
Figure 8:
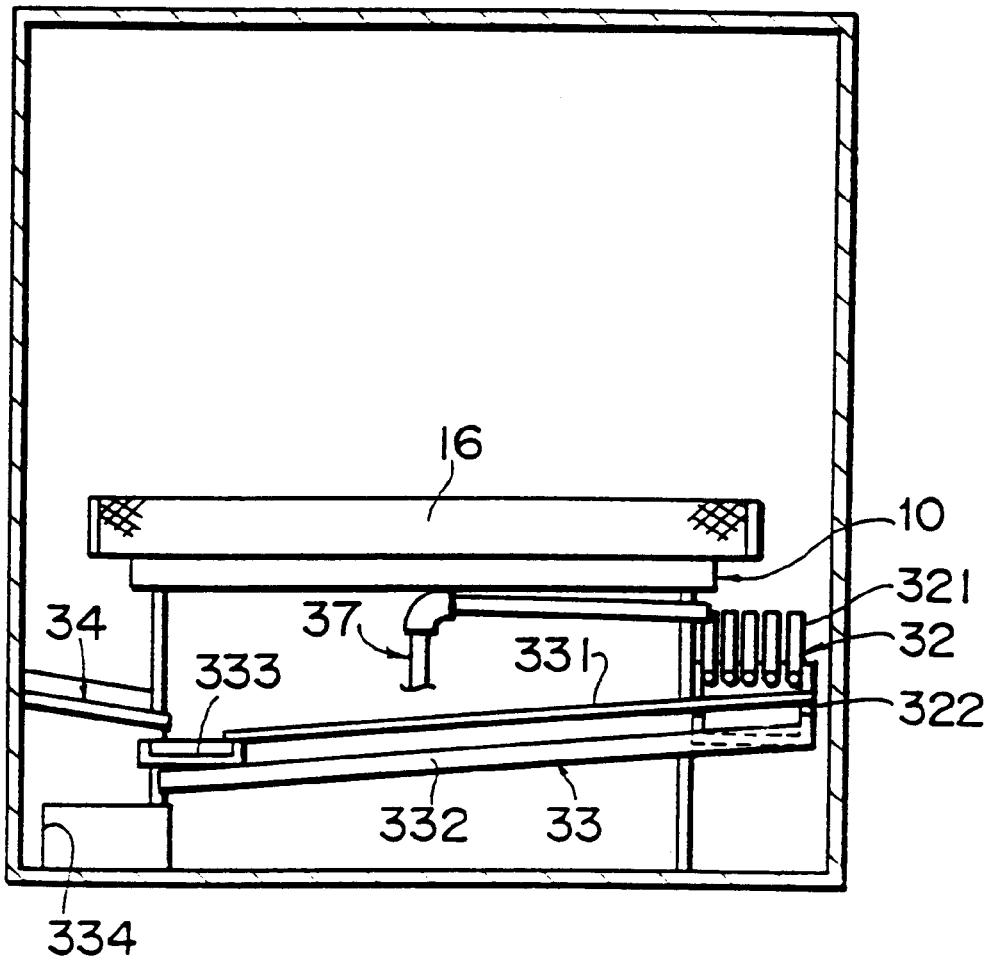
FIG. 8 is a sectional view taken along line VIII—VIII of FIG. 6.
Figure 9:
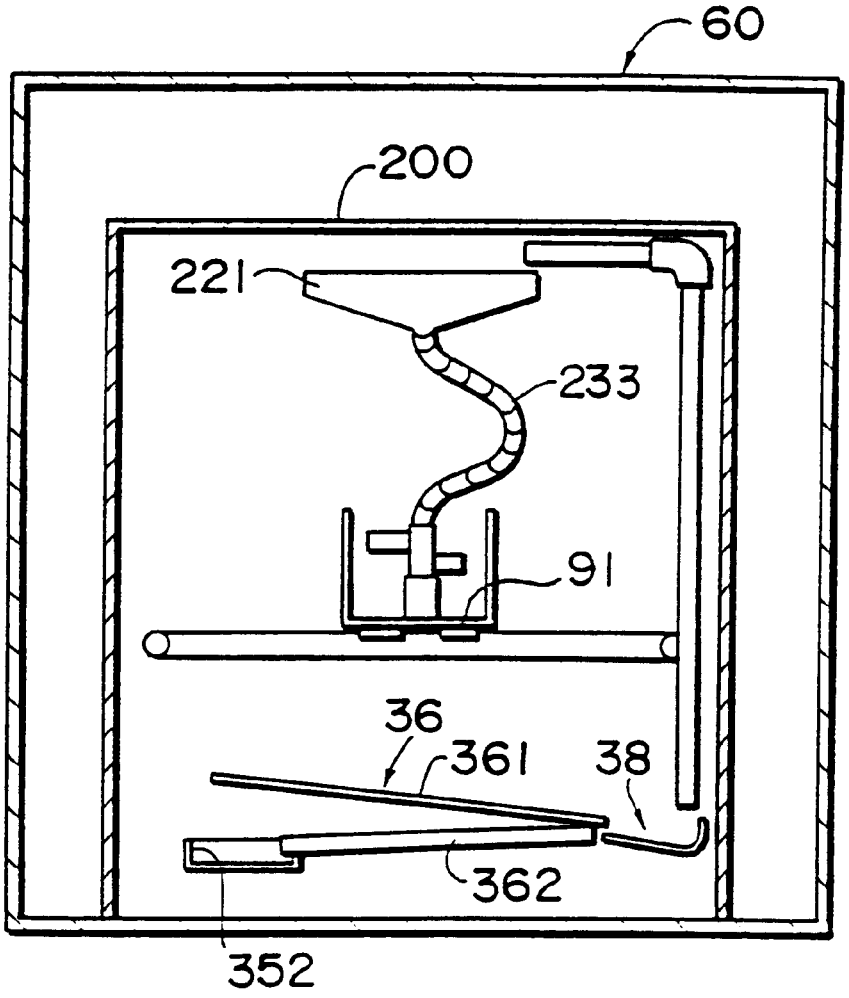
FIG. 9 is a sectional view taken along line IX—IX of FIG. 6.

A description will now be given of the moving mechanism 90. As shown in FIG. 5, the moving mechanism 90 includes a pair of guide members 92*a* and 92*b* fixed to the bottom of the base 91, a guide rail 93 which is mounted on a table 202 fixed within the casing 200 (see FIG. 1) and which is disposed along the lateral direction in which the guide members 92*a* and 92*b* are slid, a pair of pulleys 94*a* and 94*b* disposed outside both the left and right ends of the guide rail 93, a timing belt 95 which is looped over the pulleys 94*a* and 94*b* and to which the guide members 92*a* and 92*b* are attached, and a drive unit 96 for driving the pulley 94*a*. The drive unit 96 consists of a projecting section moving motor (AC servo motor) 96*a,* a pulley 96*c* fitted to a rotary shaft 96*b* of the motor 96*a,* and a timing belt 96*d* looped over the pulleys 96*c* and 94*a*.

A shielding plate 91*a* is attached in the rear center of the base 91 so as to extend downward. On the other hand, a center base sensor 97 consisting of a photo-interrupter is fixed to a sensor mounting plate 93*a,* which projects rearward from the center of the guide rail 93. In the center base sensor 97, the positions of a light emitting element and a light receiving element are set so that the shielding plate 93*a* can pass through a gap formed therebetween. This allows the initial position of the base 91, i.e., the initial position of the ball projecting section 20 in the lateral direction, to be detected when the shielding plate 91*a* interrupts between the light emitting element and the light receiving element of the sensor 97. The center position of the table 20 in the lateral direction is regarded as the initial position of the ball projecting section 20, and the lateral movement of the ball projecting section 20 is controlled based on the initial position.

A left base sensor 98 and a right base sensor 99 are fixed to sensor mounting plates 93*b* and 93*c,* respectively. The left base sensor 98 projects rearward from a left-of-center portion of the guide rail 93, and the right base sensor 99 projects rearward from a right-of-center portion of the guide rail 93 (from the point of view of the player). Each of the left and right base sensors 98 and 99 consists of a photo-interrupter in which the positions of a light emitting element and a light receiving element are set so that the shielding plate 91*a* can pass through a gap formed therebetween. This allows a lateral movement range of the base 91, i.e., a lateral movement limit position of the ball projecting section 20, to be detected when the shielding plate 91*a* interrupts between the light emitting element and the light receiving element of the left base sensor 98 or the right base sensor 99, so that the ball projecting section 20 does not overrun the limit position.

The ball collecting section 30 collects balls that have failed to be hit by the player, thus dropping on the floor, balls that have dropped on the floor from both side edges of the table 10 (so-called the sides of the side lines), and balls that have dropped from the rearward edge (so-called the side of the end line) towards the ball projecting section 20, and sorts faulty balls that have been erroneously stamped on and deformed by the player's foot into a faulty ball collecting box 334. The structure of the ball collecting section 30 is shown in FIGS. 6 to 9.

Referring to these drawings, the ball collecting section 30 includes a floor collecting part 31, left collecting part 32 disposed along the left side line of the table 10, a rear collecting part 33 disposed along the end line of the table 10, a right collecting part 34 disposed along the right side line of the table 10, a longitudinal collecting part 35 longitudinally disposed in the casing 200, a lateral collecting part 36 provided continuously to the end of the longitudinal collecting part 35 in the casing 200, a ball scooping-up unit 37 for scooping up and transferring the balls collected by the floor collecting part 31 to the left collecting part 32, and a ball scooping-up unit 38 for scooping up and transferring the balls transferred to the lateral collecting part 36 into a hopper 231.

The floor collecting part 31 is formed to include the area where the player plays. The floor collecting part 31 includes a first floor part 311 disposed to be inclined downwardly towards the table 10 to an extent in which the part 311 does not affect play, a second floor part 312 provided continuously on the side of the table 10 of the first floor part 311, and a ball gathering part 313 formed in the center of the second floor part 312. The second floor part 312 is divided into a left floor part 312*a* and a right floor part 312*b* on either side of the ball gathering part 313, and both floor parts 312*a* and 312*b* are disposed to be inclined downwardly towards the ball gathering part 313. In addition, the ball gathering part 313 is disposed to be inclined downwardly towards the playing surface 14.

By the described arrangement, balls drop on the first floor part 311 roll on the first and second floor parts 311 and 312, and are collected in the ball gathering part 313. In addition, the balls collected in the ball gathering part 313 are moved upward within a cylinder to be described later by the ball scooping-up unit 37, and are transferred to the left collecting part 32. In addition to normal spherical balls, partially dented faulty balls that have rolled into the ball gathering part 313 are transferred by the ball scooping-up unit 37 to the left collecting part 32.

The left collecting part 32 includes a plurality of (five, in the drawings) rails 321 which are disposed side by side in substantially a horizontal direction with the height lower than that of the table 10, and which are inclined downwardly towards the rear collecting part 33, and a receiver plate 322 having substantially a C-shape in vertical cross section that is disposed below the rails 321 to be inclined downwardly towards the rear collecting part 33. The rails 321 are disposed at intervals of slightly smaller than the diameter of the ball. Therefore, normal balls can be rolled between adjacent rails 321, while partially dented faulty balls drop from the spacing between adjacent rails 321 onto the receiver plate 322 and are sorted.

By the described arrangement, normal balls roll on the adjacent rails 321 and are transferred towards the rear collecting part 33, and dented faulty balls collected by the floor collecting part 31 drop from the spacing between the adjacent rails 321 onto the receiver plate 322, roll on the receiver plate 322 (or the balls that do not roll are struck by subsequent dropped balls), and are transferred to a receiver plate 332 to be described below. The rails 321 and the receiver plate 322 are arranged so that the ends thereof cross the rails 331 of the rear collecting part 33 and the receiver plate 332 in order to enable the balls to be transferred.

The rear collecting part 33 includes a plurality of (five, in the drawings) rails 331 which are disposed side by side in substantially a horizontal direction with the height lower than that of the table 10, and which are inclined downwardly towards the right side of the playing surface 14, and a receiver plate 332 which is disposed below the rails 331 to be inclined downwardly towards the right side thereof, a normal ball relay box 333 disposed below the right edges of the rails 331, and a faulty ball collecting box 334 disposed below the right edge of the receiver plate 332.

The rails 331, similarly to the rails 321, are disposed at intervals of slightly smaller than the diameter of the ball. Therefore, normal balls can be rolled between adjacent rails 331, while partially dented faulty balls drop from the spacing between adjacent rails 331 onto the receiver plate 332, and are sorted. The normal relay box 333 opens to the casing 200, and is disposed to be inclined downwardly towards the casing 200.

Since the dented faulty balls have been collected in the floor collecting part 31, most of them drop from the spacing between the adjacent rails 321 of the left collecting part 32 onto the receiver plate 322. However, since the balls on the rails 321 roll on the rails 321 using the same portions thereof as rolling axes, when the portions of the balls crossing the rolling shafts are dented, the balls do not drop from the spacing between the adjacent rails 321. Thus, with respect to the faulty balls which have not dropped from the spacing between the adjacent rails 321, the rear collecting part 33 is provided perpendicular to the left collecting part 32, whereby the rolling axes are changed to be perpendicular to the rails 321 and the dented portions are opposed between the rails 321, so that the faulty balls are dropped from the spacing between the rails 321.

This allows the normal balls to be delivered to the normal ball relay box 333 via the rails 321 and 331, and allows dented faulty balls to be dropped from the rails 321 or 331 onto the receiver plate 322 or 332, and delivered to the faulty balls collecting box 334.

The right collecting part 34 includes a plate 341 which has a height lower than that of the table 10 and which is disposed to be inclined downwardly towards the rear collecting part 33 and the table 10. The rear edge part of the plate 341 projects on the normal ball relay box 333. Since the normal balls returned by the player may probably be collected by the right collecting part 34, the balls roll on the plate 341 and are delivered to the normal ball relay box 333 for a while.

The longitudinal collecting part 35 includes a plurality of (four, in the drawing) rails 351 disposed in substantially a horizontal direction to be inclined downwardly to the rear thereof, and a receiver plate 352 disposed below the rails 351 to be inclined downwardly to the front. The intervals of the rails 351 are set similarly to those of the rails 321 and 331. The normal balls roll rearward on the rails 351, while the dented faulty balls drop from the spacing between adjacent rails 35 onto the receiver plate 352.

The front end of the receiver plate 352 is located above the faulty ball collecting box 334. Since almost all of the dented faulty balls have been collected via the floor collecting part 31, they should be collected in the faulty ball collecting box 334 when they pass through the rear collecting part 33. However, because of influence of direction of the dented portions of the faulty balls on the rails 331, the balls which have not dropped from the spacing between the adjacent rails 331 of the rear collecting part 33 will drop from the spacing between adjacent rails 351 by the change of the direction of the dented portions.

This allows the normal balls to roll on the adjacent rails 351 and are transferred toward the lateral collecting part 36, and allows the dented balls to be dropped from the spacing between adjacent rails 351 and are collected in the faulty ball collecting box 334. The rails 351 and the receiver plate 352 are arranged so that the ends thereof cross the rails 361 and a receiver plate 362 of a lateral collecting part 36 in order to enable the balls to be transferred.

The lateral collecting part 36 includes a plurality of (four, in the drawing) rails 361 disposed in substantially a horizontal direction to be inclined downwardly to the left thereof, and a receiver plate 362 disposed below the rails 361 to be inclined downwardly to the right thereof. The intervals of the rails 361 are set similarly to those of the rails 351, and the normal balls roll on the rails 361 to the left, while the dented faulty balls drop from the spacing between adjacent rails 361 onto the receiver plate 362. This is similarly applied to a case where the balls are collected from the right collecting part 34 to be guided to the longitudinal collecting part 35 and to the lateral collecting part 36. Since the collected balls from the right collecting part 34 have not passed through the left collecting part 32 and the rear collecting part 33, the faulty balls from the right collecting part 34 are sorted in the longitudinal collecting part 35 and the lateral collecting part 36.

The rails 321, 331, 351 and 361 constitute ball sorting sections, and the receiver plates 322, 332, 352 and 362 constitute deformed ball carrying sections. In addition, the rails 321 and 351 constitute a first ball sorting section, and the rails 331 and 361 constitutes a second ball sorting section.

Figure 10:
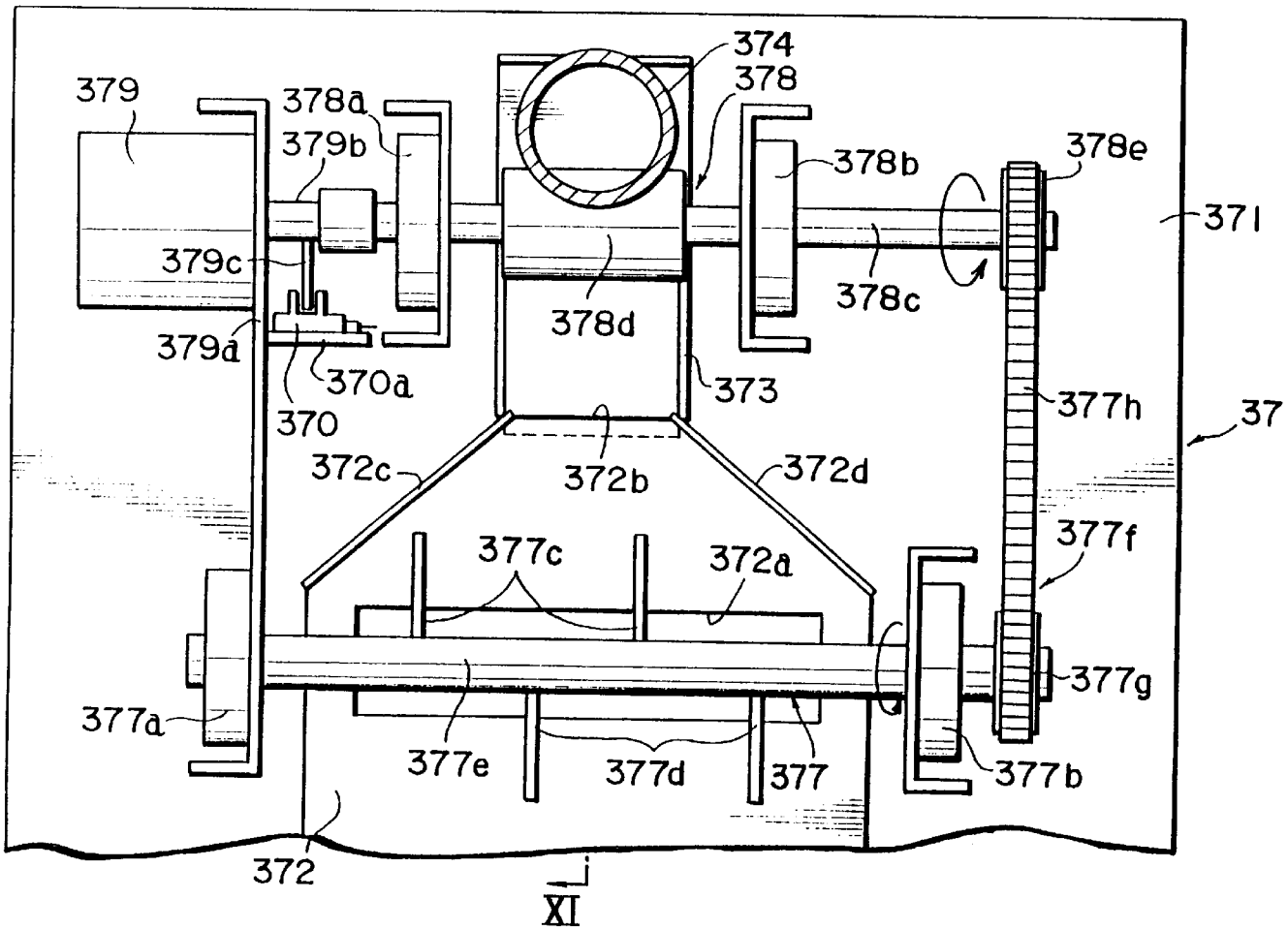
FIG. 10 is a plan view showing a construction of a ball scooping-up unit of the ball collecting section shown in FIG. 6.
Figure 11:
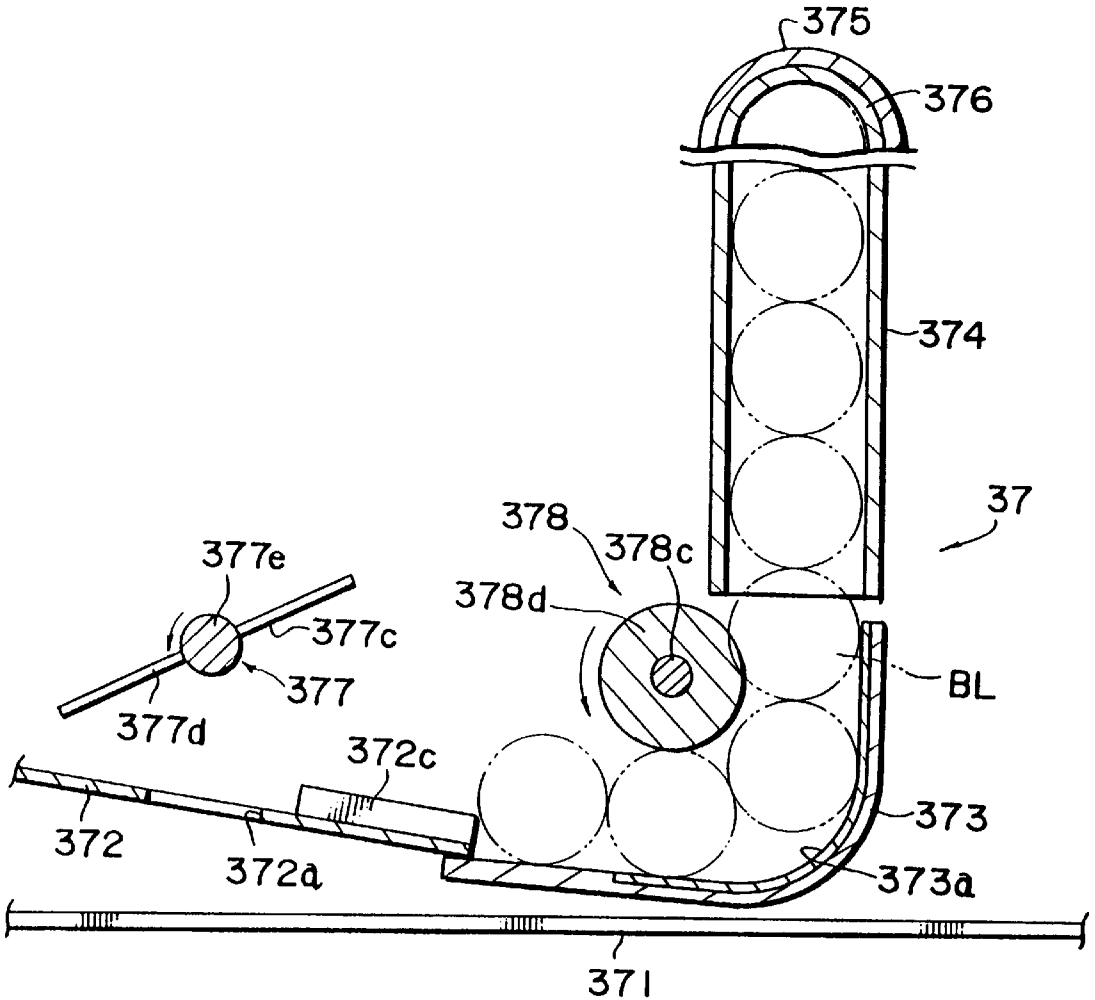
FIG. 11 is a sectional view taken along line XI—XI of FIG. 10.

Referring to FIGS. 10 and 11, the ball scooping-up unit 37 includes a flat first guide plate 372 fixed on a base plate 372 and provided continuously with the rear edge of the ball gathering section 313, a curved second guide plate 373 provided continuously with the first guide plate 372, a vertical transporting cylinder 374 provided vertically above the rear edge of the second guide plate 373, a horizontal transporting cylinder 376 which is connected to the upper portion of the vertical transporting cylinder 374 by means of a connecting cylinder 375 and which is horizontally disposed, a ball stirring unit 377 for preventing a ball jam on the rear end of the first guide plate 372, and a feeding unit 378 for feeding the balls fed to the second guide plate 373 to the vertical transporting cylinder 374.

The first guide plate 372 is disposed to be inclined downwardly towards the second guide plate 373, and has an oblong cutout 372*a* formed at the position opposite a shaft 377*e* to be described later for facilitating the passage of the balls below the shaft 377*e*. In addition, the first guide plate 372 has upright parts 372*c* and 372*d* formed at both sides of rear end thereof to form a narrow ball outlet 372*b* for passing therethrough balls one at a time.

The second guide plate 373 guides the balls rolled from the first guide plate 372 to the vertical transporting cylinder 374. A cushion member 373*a,* such as a sponge, is attached to the top surface of the second guide plate 373 by bonding or the like.

The ball stirring unit 377 includes a shaft 377*e* which is rotatably supported by bearings 377*a* and 377*b* disposed at both sides thereof, and to which a plurality of flexible stirring rods 377*c* and 377*d* are attached alternatively in opposite phase positions at intervals of substantially one ball, and a drive unit 377*f* for rotationally driving the shaft 377*e*. The drive unit 377*f* consists of a gear 377*g* attached to one end of the shaft 377*e,* a gear 378*e* attached to one end of a shaft 378*c* to be described below, and a chain 377*h* looped over the gears 377*g* and 378*e,* and is driven by a driving force of a stirring/feeding motor 379 to be described below. By the described arrangements, the shaft 377*e* is rotationally driven in the direction shown by the arrow in FIG. 11, and a plurality of balls that get trapped near the outlet 372*b* of the first guide plate 372 are stirred by the stirring rods 377*c* and 377*d* so as not to cause a ball jam near the outlet 372*b*.

The feeding unit 378 includes a shaft 378*c* which is rotatably supported by the bearings 378*a* and 378*b* disposed on both sides thereof and which is disposed above the second guide plate 373 and in front of (left side in FIG. 11) the vertical transporting cylinder 374, a feeding roller 378*d* mounted at the position opposite the vertical transporting cylinder 374, and a stirring/feeding motor 379 for rotationally driving the shaft 378*c*. The motor 379 is fixed to a motor mounting plate 379*a*. The feeding roller 378*d* is formed of an elastic member, such as a sponge or rubber, and the diameter thereof is set to a size such that the distance between the roller 378*d* and the cushion member 373*a* bonded to the curved surface of the second guide plate 373 is slightly shorter than the diameter of the ball.

By the described arrangements, when the shaft 378*c* is rotationally driven in the direction shown by the arrow in FIG. 11 to rotate the roller 378*d,* a ball is fed to the vertical transporting cylinder 374 in a state of being elastically sandwiched between the feeding roller 378*d* and the cushion member 373*a*. The ball fed into the vertical transporting cylinder 374 is pushed upward by the sequentially fed balls, and is delivered to the horizontal transferring cylinder 376. The ball delivered to the horizontal transporting cylinder 376 is transferred to the left collecting part 32.

A sensor mounting plate 370*a* is attached to the motor mounting plate 379*a,* and a first motor rotation sensor 370 consisting of a photo-interrupter having a light emitting element and a light receiving element is fixed to the sensor mounting plate 370*a*. A shielding plate 379*c* fitted to a rotary shaft 379*b* of the motor 379 passes through a gap formed between the light emitting element and the light receiving element of the sensor 370, whereby the number of rotations of the motor 379 is counted.

Since the ball scooping-up unit 38 is of identical structure to the ball scooping-up unit 37, a description thereof will be omitted.

The display section 40 is disposed on the front surface of the casing 200, and includes a point display section 41 consisting of a 7-segment indicator, and an image display section 42 consisting of a dot-matrix indicator. The point display section 41 displays the number of remaining balls with respect to a predetermined number of balls, and displays each time a point obtained by the player by returning the ball from the ball projecting section 20 to the playing surface 14 is added. The image display section 42 displays a demonstration picture before starting the play, a presentation picture during the play, a demonstration picture when the play is over, a high score and the like.

The sound section 50 consists of amplifiers, speakers and so forth, and outputs a presentation music and sound effects during display of the demonstration picture and during the play, a ball projection sound each time the ball is projected from the ball projecting section 20, and a sound effect when the ball returned by the player drops within the playing surface 14.

The box 60 consists of a net or the like, and prevents the ball projected from the ball projecting section 20 and the ball returned by the player from flying far away. A door 61 for the player is provided on the right of the box 60.

The control box 70 is mounted on the right of the playing surface 12 of the table 10, and is placed across the inside and the outside of the box 60. Inside the box 60, there are provided a coin entrance CE in which a prescribed coin is slotted before starting play, a start button SW1, a game mode select button SS (a first course button SS1, a middle course button SS2, and an advanced course button SS3) for use in selecting one of three types of game (training) modes of different degree of difficulty, and a coach mode select button CS for enabling the game to be played by two players.

Outside the box 60, there are provided a start button SW2, and an area select button PS for use in selecting a drop area (drop position) of the ball in the playing surface 12 projected from the ball projecting section 20. The area select button PS is used for dividing the playing surface 12 into two areas in the longitudinal direction, and for selecting one of the total six areas divided in the lateral direction. The button PS consists of six buttons PS1, PS2, PS3, PS4, PS5 and PS6 for individually selecting the areas. When one of the buttons is pushed, a spin-applied ball, for example, projected from the ball projecting section 20 drops on the selected area.

In the described arrangements, when the player plays alone, a coin is slotted in the coin entrance CE, a predetermined game mode is selected by the game mode selection button SS and then, the start button SW1 is pushed, whereby the game is started. When the player plays the game with a competitor to imitate a coach, a coin is slotted in the coil entrance CE, the coach mode select button is pushed and then, the start button SW2 is pushed by the competitor standing outside the box 60, whereby the game is started. The competitor pushes a predetermined button to suitably select the drop area of the ball in accordance with the player's skill, before the ball is projected from the ball projecting section 20, and then advances the play. Even if the coach mode select button CS is pushed, the ball is projected under a preset condition unless the area select button PS is pushed.

A type of projection of ball select button, a ball speed select button, a ball projecting position select button, a ball projecting angle select button, a ball projecting direction select button and the like may be provided so that, by pushing these select buttons when the coach mode is selected, the type of projection of ball, speed, projecting position and the like can be suitably selected each time the ball is projected.

Figure 12:
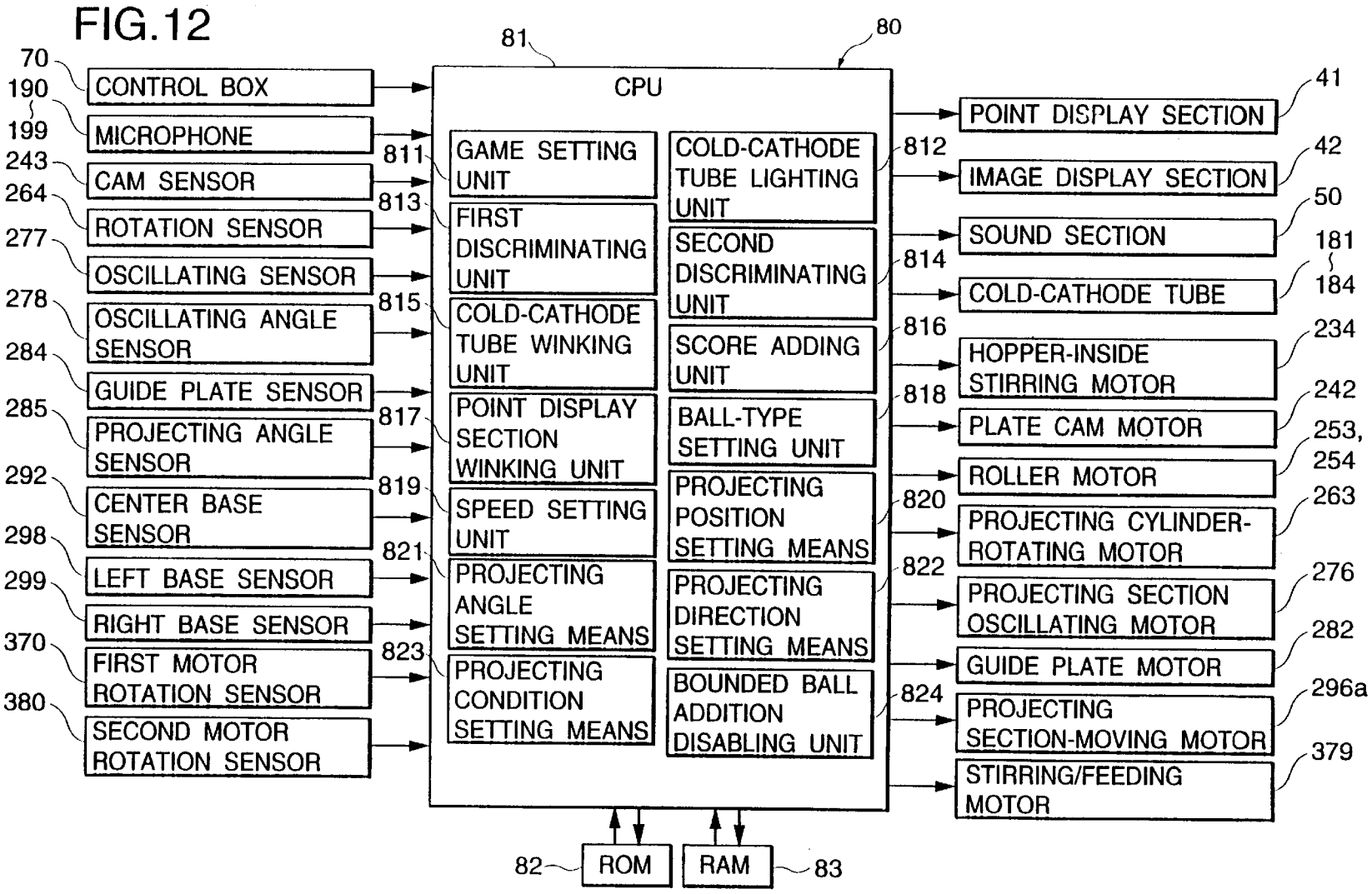
FIG. 12 illustrates a control block of the table tennis apparatus according to the present invention.

Referring to FIG. 12, the control section 80 consists of a CPU for performing predetermined calculation and control processing, a ROM 82 in which a predetermined processing program is stored, and a RAM 83 for temporarily storing data. The entire operation of the table tennis apparatus is controlled in accordance with the above predetermined processing program.

The CPU 81 includes the following functional units: a game setting unit 811 for setting game contents in accordance with any one of the game modes selected from the three game modes of the first, medium, and advanced courses, a cold-cathode tube lighting unit 811 for selectively lighting the cold-cathode tubes 181 to 184 in accordance with a lighting command, a first discriminating unit 812 for discriminating whether or not a ball dropped onto the playing surface 14, a second discriminating unit 813 for discriminating whether or not the ball dropped onto the cold-cathode tube lighting area, a cold-cathode tube winking unit 815 for selectively winking the cold-cathode tubes in accordance with a winking command, a score adding unit 816 for adding the present score to the score that is obtained immediately before the present score in accordance with the results of discrimination of the first and second discriminating units 813 and 814, a point display section winking unit 817 for winking the point display section 41 when the score is added, a ball type setting unit for setting the type of projection of ball from the ball projecting section 20 in accordance with a setting command, a speed setting unit 819 for setting the speed of the ball projected from the ball projecting section 20, a projecting position setting unit 820 for setting a projecting position of the ball from the ball projecting section 20, a projecting angle setting unit 821 for setting a projecting angle of the ball from the ball projecting section 20, a projecting direction setting unit 822 for setting a projecting direction of the ball from the ball projecting section 20, a projecting condition setting unit 823 for setting a projecting condition of a ball so that the ball is projected towards the selected drop area in accordance with a pushing operation of the area selection button when the coach mode is selected, and a bounded ball addition disabling unit 824 for disabling a score addition with respect to the second drop of the ball bounded on the playing surface 14.

A description will now be given of an example of the table tennis apparatus constructed as described above.

Figure 13:
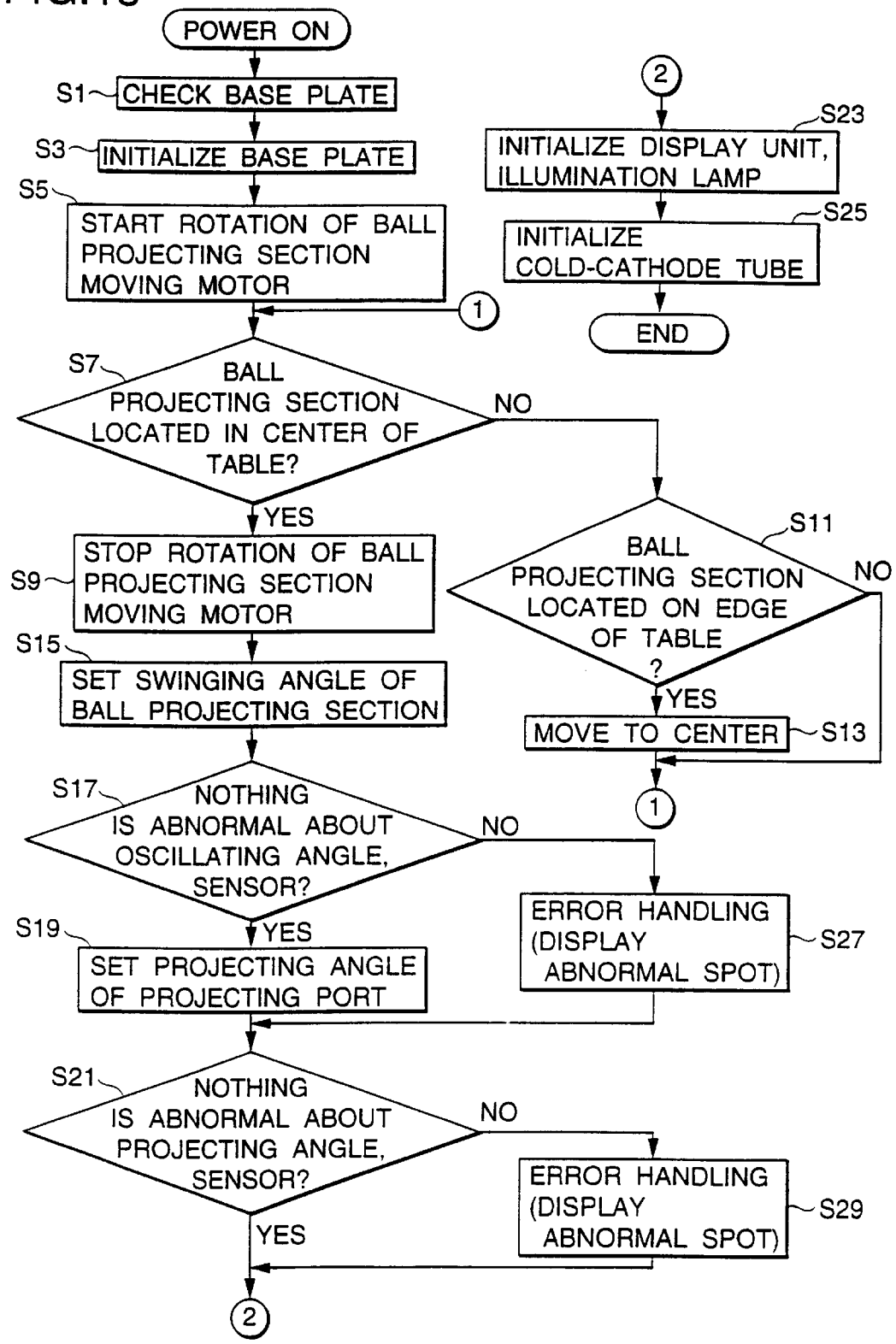
FIG. 13 is a flow chart for the explanation of initialization of the table tennis apparatus according to the present invention.

First, an initializing operation of each of the components will be described with reference to a flow chart shown in FIG. 13.

When a power switch is turned on, a base plate is checked to determine whether or not the components such as the CPU and the like are functioning normally (step S1), and then the components are initialized (step S3). Then, the ball projecting section moving motor 296*a* is rotationally driven to move laterally the ball projecting section 20 (step S5), and after a lapse of a fixed period of time, it is determined whether or not the ball projecting section 20 is located in the center of the table 10 (step S7). If "yes", the rotation of the motor 296*a* is stopped. If "no", it is determined whether or not the ball projecting section 20 is located on the left end or the right end of the table 10 (step S11). If "yes" in step S11, the ball projecting section 20 is moved to the center of the table 10 (step S13) and thereafter, the procedure returns to step S7. If "no" in step S13, it is determined that the ball projecting section 20 is moving to the center of the table 10 and the procedure returns to step S7 to execute subsequent operations.

Then, the oscillating angle of the ball projecting section 20 in the lateral direction is set (step S15) and the ball projecting section 20 is laterally rotated. It is determined whether or not there is anything abnormal about the oscillating angle and the oscillating sensor 277 (step S17), and a projecting angle of the projecting port 211 is set (step S19) when "yes" in step S17. Thereafter, the guide plate 281 of the projecting port 211 is rotated by the angle corresponding to the set projecting angle, and it is determined whether or not there is anything abnormal about the guide plate sensor 283 and the projection angle sensor 285 (step S21). If "yes" in step S21, the point display section 41, the image display section 42 and the illumination lamp (not shown), and the like are initialized and the cold-cathode tubes 181 to 184 are subsequently initialized (step S25). If "no" in step S17 and step S21, error handling (for example, display of the abnormal section on the image display section 42) is performed (step S27 and step S29).

Figure 14:
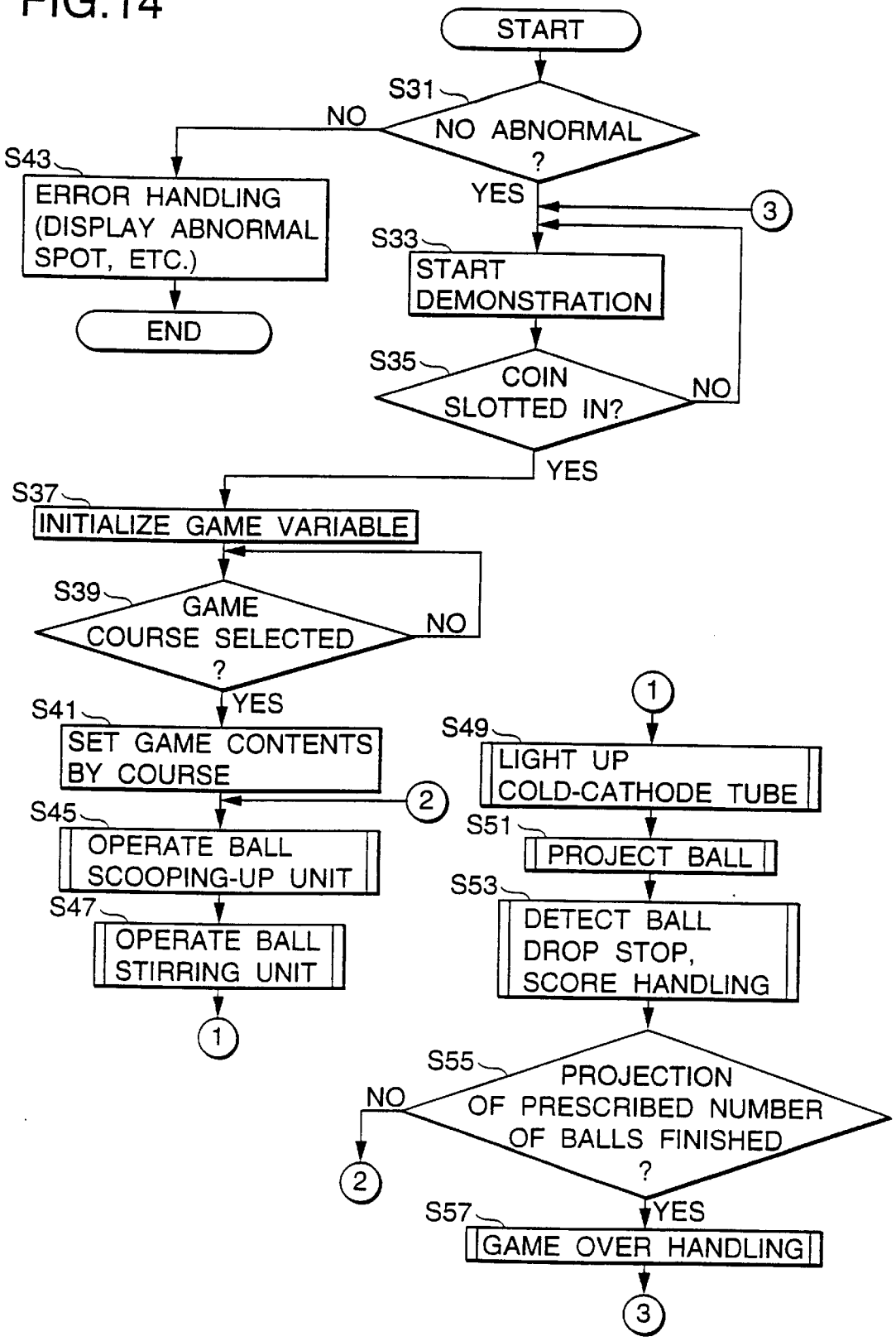
FIG. 14 is a flow chart for the explanation of a game operation of the table tennis apparatus according to the present invention.

A game operation will now be described with reference to the flow chart shown in FIG. 14. First, it is determined whether or not there is anything abnormal in the initializing operation of the components as described above (step S31). If "yes", a demonstration picture before starting the play is displayed on the image display section 42 (step S33). Then, it is determined whether or not a coin has been slotted in the coin entrance CE (step S35). If "yes", game variables (the number of remaining ball, the projecting angle, and the like) are initialized (step S37).

Then, it is determined whether or not a predetermined game course among the first course, the middle course and the advanced course is selected (step S39). If "yes", the game contents corresponding to the game course is set (step S41). If "no" in step S31, error handling (such as the display of the abnormal section on the image display section 42) is performed (step S43) to make it impossible to start the game. In addition, if "not" in step S39, the determination is repeatedly executed until the game course is selected.

When the game contents are set in step S41, the ball scooping-up units 37 and 38 of the ball collecting section 30 are actuated (step S45), the ball stirring unit 236 of the ball supply section 236 is actuated (step S47), and a predetermined color-luminary cold-cathode tube in the cold-cathode tubes 181 to 184 is lit up immediately before the projection of ball (step S49). Then, a ball is projected from the ball projecting section 20 towards the playing surface 12 (step S51), and the drop position of the ball returned by the player is detected to perform score handling (step S53). Thereafter, it is determined by a count value of the plate cam sensor 243 whether or not the prescribed number of balls are projected from the ball projecting section 20 (step S55). If "yes", the procedure returns to step S45, and subsequent operations are repeatedly executed.

The operations in steps S45, S47, S49, S51, S53 and S57 shown in FIG. 14 will now be described in this order with reference to the flow charts of FIGS. 15 to 20. While these operations are repeatedly executed in a predetermined cycle, for example, 1/60 seconds, the flow charts of FIGS. 15 to 20 focus on the operations for reasons of explanation.

Figure 15:
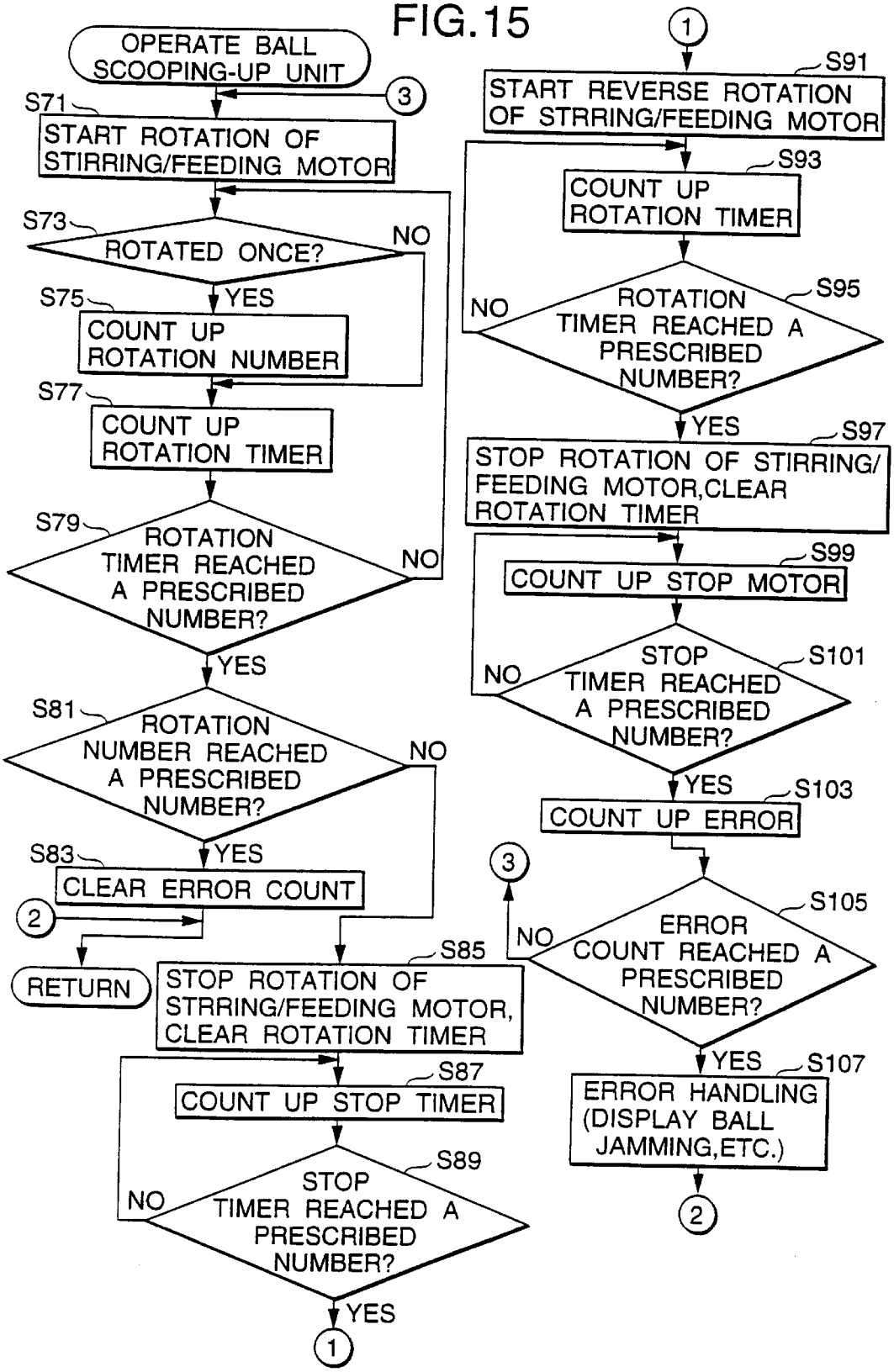
FIG. 15 is a flow chart for the explanation of an operation of the ball scooping-up unit of the ball collecting section.

The operations of the ball scooping-up units 37 and 38 will be first described with reference to the flow chart of FIG. 15. Since the operation of the ball scooping-up unit 37 is identical to that of the ball scooping-up unit 38, a description will be given of the operation of the ball scooping-up unit 37.

First, the stirring/feeding motor 379 is started to rotate in a normal direction (step S71), and it is determined whether or not the motor has rotated once (step S71). If "yes", the number of rotations is counted up (step S75), and a rotation timer is consecutively counted up (step S77).

Thereafter, it is determined whether or not the count of the rotation timer has reached a prescribed number (step S79).

If "yes", it is determined whether or not the number of rotations of the motor 379 has reached a prescribed number (step S81). If "yes" in step S81, the error count is cleared (step S83). That is, when a ball jam does not occur in the vicinity of the ball stirring section 377 and the motor 379 is normally operated, the operations of steps S71 to S83 are repeatedly executed during proceeding of the game. If "no" in step S73, the procedure advances to step S77. If "no" in step S79, the procedure returns to step S73, and subsequent operations are repeatedly executed until the count of the rotation timer reaches the prescribed number.

On the other hand, if "no" in step S81, i.e., the ball jam occurs in the vicinity of the ball stirring section 377 and the motor 379 is not rotated normally, the rotation of the motor 379 is stopped to clear the rotation timer (step S85), and a stop timer is counted up (step S87). Then, it is determined whether or not the count of the stop timer has reached a prescribed number (step S89). If "yes", the motor 379 is started to rotate in a reverse direction (step S91). That is, the motor 379 is rotated in the reverse direction to eliminate the ball jam occurred in the vicinity of the ball stirring section 377. If "no" in step S89, the procedure returns to step S87, and the determination is repeatedly executed until the count of the stop timer reaches the prescribed number.

When the motor 379 is rotated in the reverse direction in step S91, the stop timer is cleared, while the rotation timer is counted up (step S93). Consecutively, it is determined whether or not the count of the rotation timer has reached a prescribed number (step S95). If "yes", the rotation of the motor 379 is stopped to clear the rotation timer (step S97), and the stop timer is counted up (step S99). Then, it is determined whether or not the count of the stop timer has reached the prescribed number (step S101). If "yes", an error is counted up (step S103). If "no" in step S101, the procedure advances to step S99 and the determination is repeatedly executed until the count of the stop timer reaches the prescribed number.

Consecutively, it is determined whether or not the error count reaches a prescribed number (for example, 3) (step S105). If "no", the procedure returns to step S71 and subsequent operations are repeatedly executed. That is, when the ball jam is eliminated by rotating the motor 379 in the reverse direction, steps S71 to S83 are repeatedly executed. When the ball jam is not eliminated by repeating the operations in steps S85 to S103 of prescribed times (for example, three times), the determination in step S105 is "yes" and error handling (for example, display of the ball jam on the image display section 42). In this case, the balls are not projected from the ball projecting section 20 after a lapse of a fixed period of time. Thus, the proceeding of the game is stopped when the balls are not projected.

Figure 16:
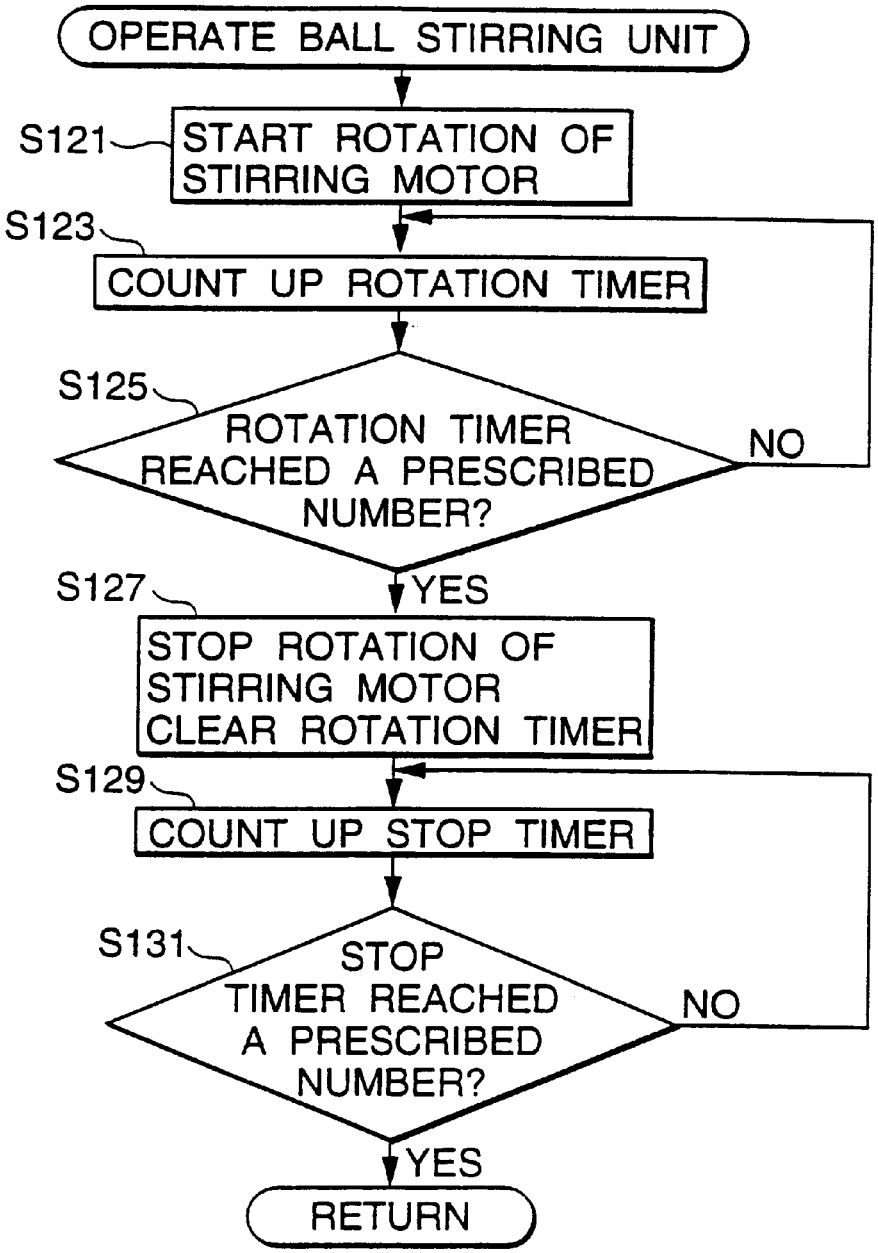
FIG. 16 is a flow chart for the explanation of a ball stirring unit of a ball supply section in the table tennis apparatus according to the present invention.

The operation of the ball stirring unit 236 of the ball supply section 23 shown in step 47 of FIG. 4 will now be described with reference to the flow chart shown in FIG. 16.

First, the hopper-inside stirring motor 234 is stated to rotate (step S121). Then, the rotation timer is counted up (step S123) and thereafter, it is determined whether or not the count of the rotation timer has reached a prescribed number (step S125). If "yes", the rotation of the motor 234 is stopped, and the rotation timer is cleared (step S127), and the stop timer is counted up (step S129). Then, it is determined whether or not the count of the stop timer has reached a prescribed number (step S131). If "yes", the procedure returns to step S121, and subsequent operations are repeatedly operated. If "no" in step S125, the procedure returns to step S123 to execute repeatedly the determination until the count reaches the prescribed number. In addition, if "no" in step S131, the procedure returns to step S129 to execute repeatedly the determination until the count reaches the prescribed number.

Figure 17:
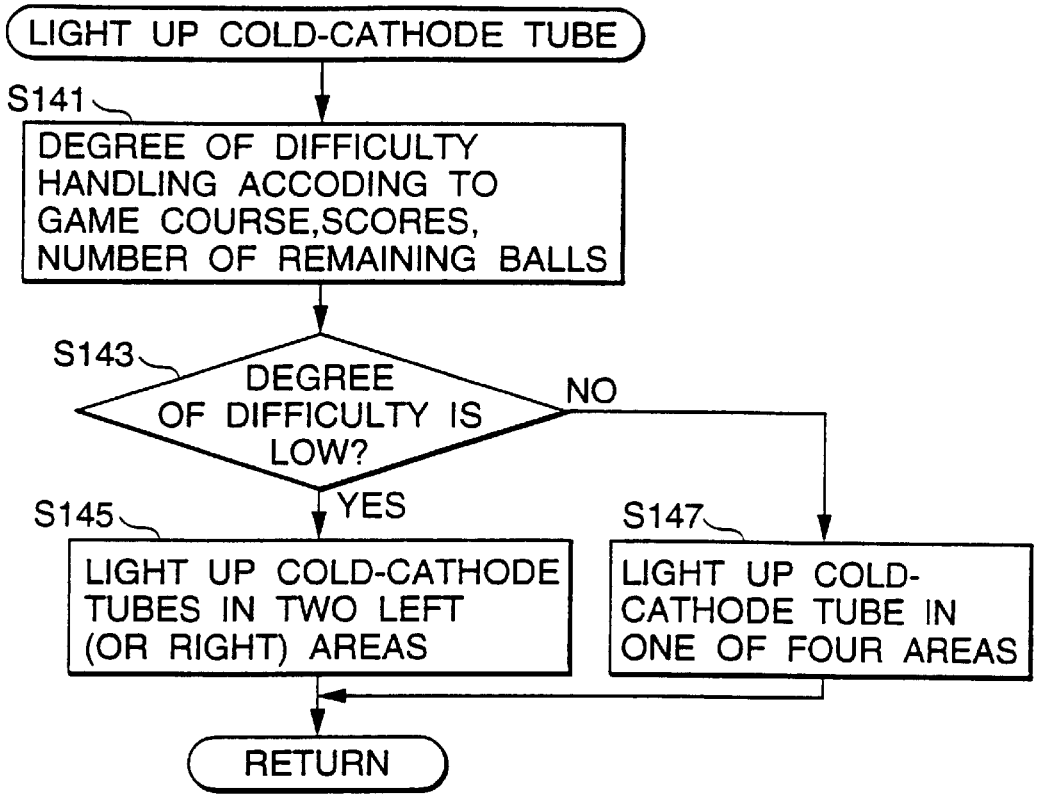
FIG. 17 is a flow chart for the explanation of a light-up operation of a cold-cathode tube of a table in the table tennis apparatus according to the present invention.

The lighting operation of the cold-cathode tubes 181 to 184 in step S49 shown in FIG. 14 will now be described with reference to the flow chart shown in FIG. 17.

First, degree of difficulty handling according to the game course, score and the number of remaining balls is executed (step S141). That is, when the game course of the low degree of difficulty (for example, the first course and the middle course) is selected, the degree of difficulty handling is performed so that the cold-cathode tubes in a plurality of areas of E2 to E5 of the playing surface 14 are lit up to make it easy to obtain scores. On the other hand, when the game course of the high degree of difficulty (for example, the advanced course) is selected, the degree of difficulty handling is performed so that the cold-cathode tube in one of the areas of E2 to E5 of the playing surface 14 are lit up to make it difficult to obtain scores. Even if the game course of the low degree of difficulty has been selected, when the score exceeds a predetermined value or the number of remaining balls decreases to less than a predetermined value, the degree of difficulty handling is performed so that the cold-cathode tubes in one of the areas of E2 to E5 of the playing surface 14 are lit up to make it difficult to obtain scores.

Then, before the projection of balls from the ball projecting section 20, it is determined whether or not the degree of difficulty is low (step S143). If "yes", the cold-cathode tubes 182 and 184 (or 181 and 183) of the left-side (or right-side) two areas E3 and E5 (or E2 and E4) are lit up simultaneously. If "no" (i.e., when the degree of difficulty is high), the cold-cathode tube 181, 182, 183 or 184 in one of the four areas of E2 to E5 is lit up (step 147).

Figure 18:
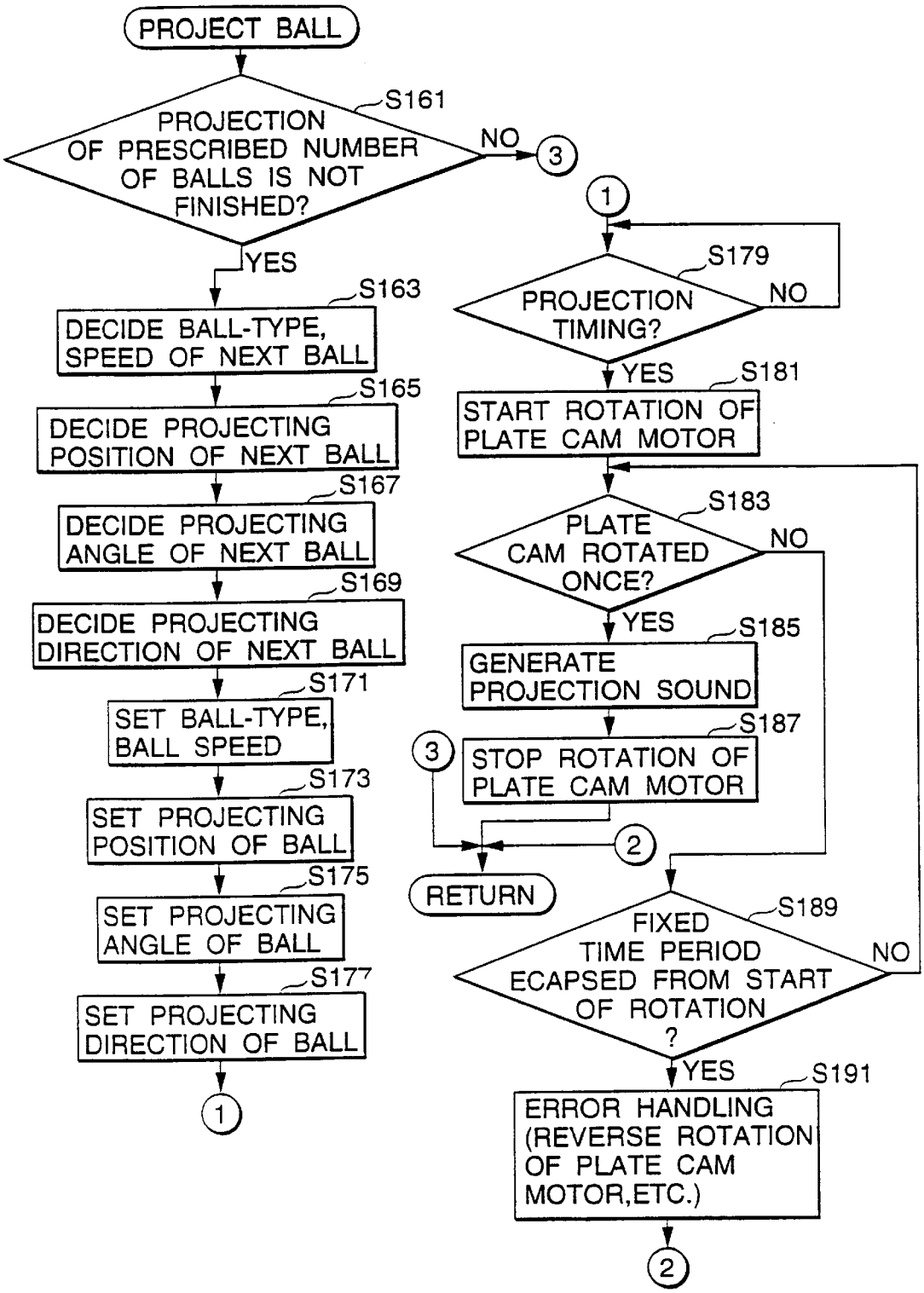
FIG. 18 is a flow chart for the explanation of ball projecting operation of the ball projecting section.

The ball projecting operation of the ball projecting section 20 in step S51 shown in FIG. 14 will now be described with reference to the flow chart shown in FIG. 18.

First, it is determined whether or not the projection of a prescribed number of balls has not been finished (step S161). If "yes", the type of projection and the speed of the next ball to be projected are decided (step S163) according to the degree of difficulty of the game (that is decided by the selected game course, the present score and the present number of remaining balls). That is, when the degree of difficulty is high, the type of projection of ball, a manner of application of spin and the like are frequently changed, and the projecting speed is increased. When the degree of difficulty is low, the type of projection of ball, a manner of application of spin and the like are not changed so frequently, and the projecting speed is decreased. If "no" in step S161, the operation shifts to that of step S53 shown in FIG. 14.

Then, the projecting position of the next ball to be projected is decided according to the degree of difficulty of the game (step S165). That is, when the degree of difficulty of the game is high, the ball projecting section 20 is moved laterally on the rear end of the playing surface 14 in accordance with the drop position of the ball returned by the player in the playing surface 14.

That is, when the ball has dropped onto the right-side second area E2 or the fourth area E4 of the playing surface 14, the drop of the ball onto the second area E2 or the fourth area E4 is discriminated by a detection signal output from a pair of the microphones 192 and 193 or 196 and 197, and the ball projecting section 20 is moved to the center position or the right-end position on the right-half of the table 10. In addition, when the ball has dropped onto the left-side third area E3 or the fifth area E5 of the playing surface 14, the drop of the ball onto the third area E3 or the fifth area E5 is discriminated by a detection signal output from a pair of the microphones 194 and 195 or 198 and 199, and the ball projecting section 20 is moved to the center position or the left-end position on the left-half of the table 10. The movement of the ball projecting section 20 is controlled by the number of pulses supplied to the projecting section moving motor 96*a*.

When the degree of difficulty of the game is low, the ball projecting section 20 is fixed to the center position, left-end position or the right-end position of the table 10 regardless of the drop position of the ball returned by the player on the playing surface 14.

Then, the projecting angle of the next ball to be projected is decided according to the degree of difficulty of the game (step S167). That is, when the degree of difficulty of the game is high, the projecting angle is frequently changed, or a ratio of the projection of the ball in a path describing a parabola is decreased, and a ratio of the projection of the low ball is increased. In addition, when the degree of difficulty of the game is low, the projecting angle is not frequently changed, or a ratio of the projection of the ball in a path describing a parabola is increased, and a ratio of the projection of the low ball is decreased.

Then, the projecting direction (straight direction or crosswise direction) of the next ball to be projected is decided according to the degree of difficulty of the game (step S169). That is, when the degree of difficulty of the game is high, the projecting direction is frequently changed, while the projecting direction is not changed so frequently when the degree of difficulty of the game is low.

Then, the number of rotations of the roller motors 253 and 254 of the urging force-imparting unit 25 is quickly changed by a PWM control (pulse width modulation control), and the projecting cylinder rotating motor 263 of the rotary unit 26 is driven by the supplied voltage of a predetermined number of pulses, whereby the ball projecting section 20 is rotated in the normal direction or the reverse direction by a predetermined angle, and the type of projection of ball and the ball speed is set to be the type and the speed decided in step S163 (step S171). In addition, the projecting section moving motor 96*a* is driven by the supplied voltage of a predetermined number of pulses, whereby the ball projecting section 20 is moved to a predetermined leftward or rightward position, and the ball projecting position is set to the position decided in step S163 (step S173). The type of projection of ball in steps S163 and S171 refers to the type which is changed by the manner of application of spin by the urging force-imparting unit 25 and the rotary unit 26 on the ball. However, the ball speed changed by the urging force-imparting unit 25, and the ball in a path describing a parabola produced by the angle changing unit 28 may be included in the type of projection of ball.

In addition, the guide plate motor 282 is driven until the voltage value output from the sensor 285 reaches a predetermined value, whereby the guide plate 281 is rotated by a predetermined angle, and the ball projecting angle is set to the angle decided in step S167 (step S175). Furthermore, the projecting section oscillating motor 276 is driven until the voltage value output from the oscillating angle sensor 278 reaches a predetermined value, whereby the ball projecting section 20 is rotated leftward or rightward by a predetermined angle, and the ball projecting direction is set to the direction decided in step S169 (step S177).

When the coach mode selection switch CS of the control box 70 is turned on, the operations of steps S163 to S169 are operated according to a signal that is output by turning on any one of the area select switches PS1 to PS6 provided in the control box 70. In addition, even if the coach mode selection switch CS is turned on, the ball is projected under programmed conditions when no area selection switches are turned on.

Then, it is judged whether or not the ball projecting timing (for example, one projection per two seconds) has been provided (step S179). If "yes", the plate cam motor 242 is started to rotate, and the plate cam 241 is rotated in response thereto (step S181). If "no" in step S179, the determination is repeatedly executed until the projection timing is provided.

Then, it is determined whether or not the plate cam 241 has rotated once (step S183). If "yes", a projection sound (for example, a sound effect generated when a ball is hit by a racket) is generated (step S185). Thereafter, the rotation of the plate cam motor 242 is stopped and the rotation of the plate cam 241 is stopped in response thereto (step S187). If "no" in step S183, it is determined whether or not a fixed period of time has elapsed since the plate cam 241 is started to rotate (step S189). If "yes", error handling (for example, display of the ball jam) is performed (step S191). If "no" in step S189, the procedure returns to step S183, and subsequent operations are repeatedly executed.

Figure 19:
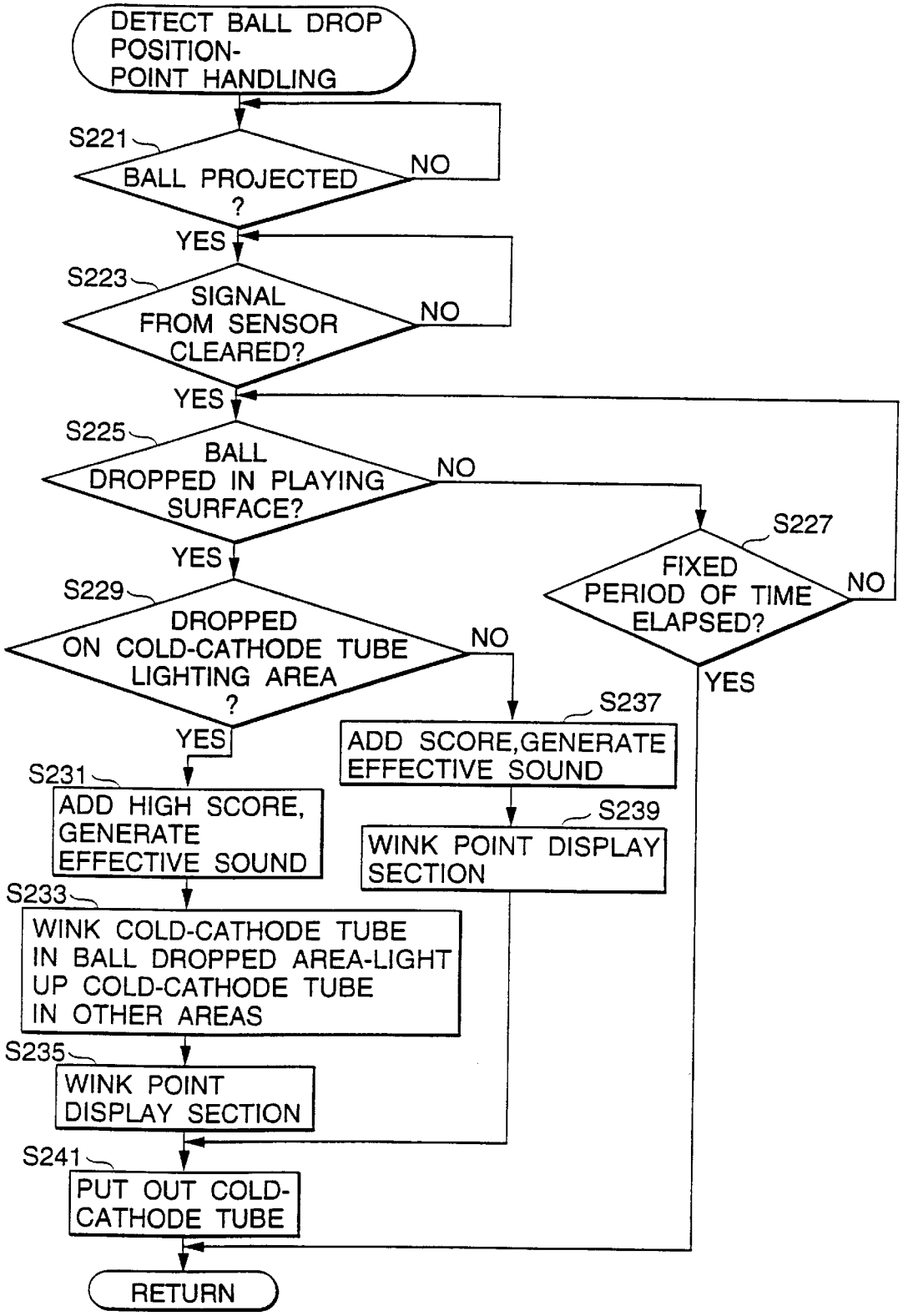
FIG. 19 is a flow chart for the explanation of the detection of ball drop position and a score handling operation in the table tennis apparatus according to the present invention.

The detection of the drop position of the ball, and score handling in step S53 shown in FIG. 14 will now be described with reference to the flow chart shown in FIG. 19.

First, it is determined whether or not the ball is projected from the ball projecting section 20 (step S221). If "yes", it is determined whether or not the last detection signals output from the microphones 190 to 199 are cleared (step S223). If "yes", it is determined whether or not the ball returned by the player has dropped onto the playing surface 14 (step S225). If "no" in step S223, the determination is repeatedly executed until the above detection signals are cleared, and even if the next signals are output from the microphones 190 to 199 during the determination, the signals are ignored.

That is, when "yes" in step S221, a flag is set up, and while the flat is being set up, the detection signals from the microphones 190 to 199 that are output only when the ball drops on the playing surface 14 are incorporated into the score adding unit 816. On the other hand, once the detection signals have been incorporated into the score adding unit 816, the above flag falls, and even if the ball drops again on the playing surface 14 by bounding and the detection signals are output, the signals are ignored and are not incorporated into the score adding unit 816.

However, when the previously projected ball is returned in a path describing a parabola to drop on the playing surface 14 immediately before the projection of the next ball, and bounds to drop on the playing surface 14 immediately after the projection of the next ball, a score is added doubly by the bound of the previously projected ball, and the score is not added by the next ball. Therefore, a detection signal output by the first bound is held for a fixed period of time (for example, 0.5 seconds), and even if the next detection signal is output during the holding time, the signal is ignored, thereby preventing the score from being added doubly.

Figure 21A:
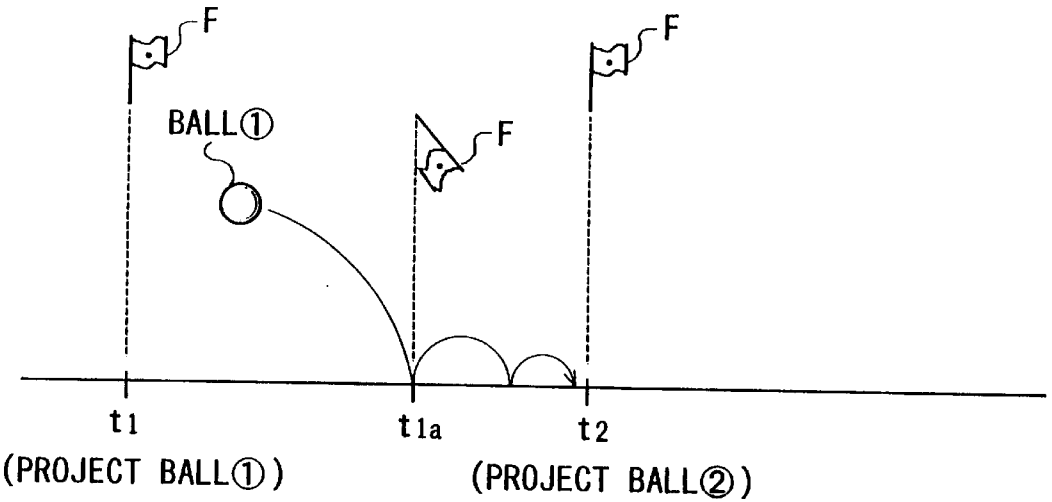
FIG. 21 is a schematic diagram for the explanation of ball scoring operation in the table tennis apparatus according to the present invention.

A specific example will be described. As shown in FIG. 21A, it is assumed that the first ball ① is projected from the ball projecting section 20 at the time $t_1$ and a flag F is set up, and the second ball ② is projected and a flag F is set up at the time $t_2$, for example, after two seconds. In this case, even if the first ball ① that has been returned on the playing surface 14 continuously bounds on the playing surface 14 immediately before the projection of the second ball ②, the flag F falls at the first bound time $t_{1a}$, so that no detection signals resulting from subsequent bounds are incorporated into the score adding unit 816.

Figure 21B:
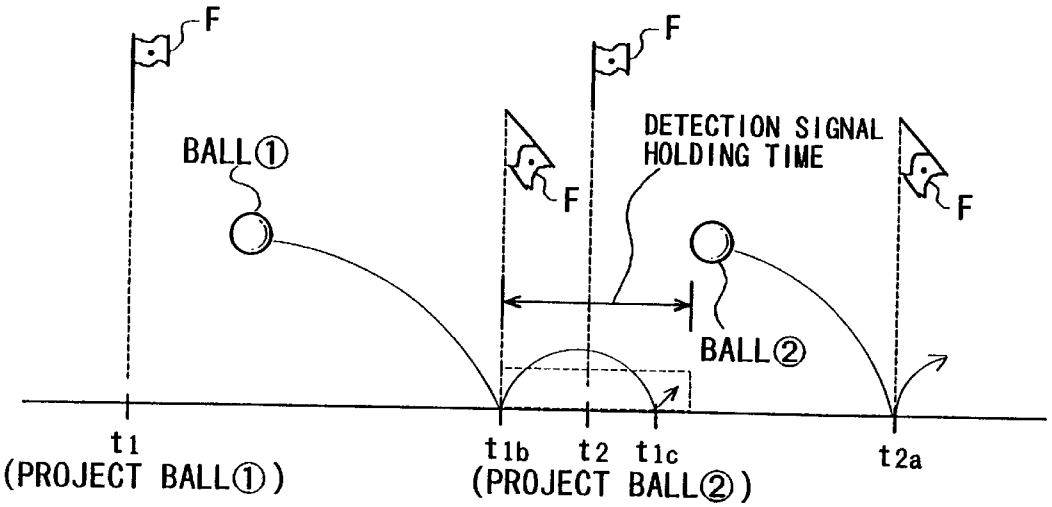

As shown in FIG. 21B, however, if the ball ① bounds on the playing surface 14 at the time $t_{1b}$ immediately before the projection of the ball ② and bounds again at the time $t_{1c}$ immediately after the projection of the ball ②, the flag F is set up by the projection of the ball ① immediately before the bound at the time $t_{1b}$, and the flag F is set up by the projection of the ball ② immediately before the second bound at the time $t_{1c}$. Thus, both detection signals are incorporated into the score adding unit 816.

Figure 2:
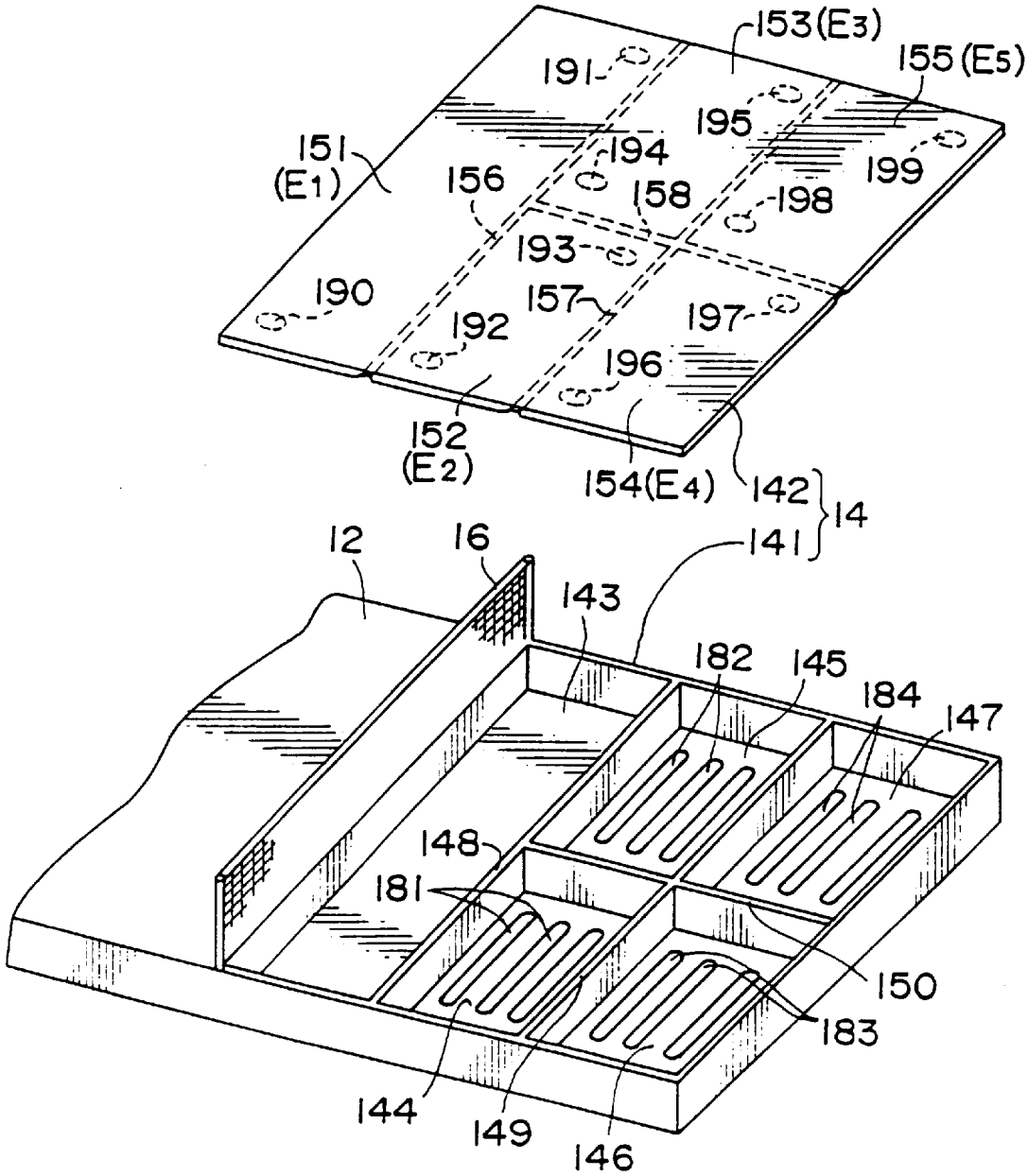
FIG. 2 illustrates a construction of one playing surface of a table in the table tennis apparatus shown in FIG. 1.

In this case, if the detection signal is held for, for example, 0.5 seconds after the first bound time $t_{1b}$ and a gate is provided so as not to receive new detection signal during this period, as shown in FIG. 2 1B, the detection signal resulting from the first bound of the ball ① is incorporated into the score adding unit 816, but the detection signal resulting from the second bound is not incorporated into the score adding unit 816 when the holding of the detection signal is cleared after the second bound time $t_{1c}$ of the first ball ①.

The ball ② usually bounds at the time $t_{2a}$ after the detection signal of the ball ① is cleared, and the detection signal resulting from the bound is incorporated into the score adding unit 816. The above 0.5 seconds is an example of the period of time for holding the detection signal. The time may be set to the time corresponding to the maximum value of the bound time, or slightly longer.

Returning to FIG. 19, if "no" in step S225, it is determined whether or not a fixed period of time has elapsed (step S227). If "yes", the procedure advances to step S55 shown in FIG. 14. If "no", the procedure returns to step S225 and the determination is repeatedly executed until the fixed period of time elapses. If "yes" in step S225, it is determined whether or not the ball returned by the player has dropped onto the areas E2 to E5 where the cold-cathode tubes 181 to 184 are being lit up (step S229). If "yes", a high score (for example, 2 points) is added to the previous score, and a sound effect, such as a music for honoring the score, is output for a fixed period of time (step S231). In this embodiment, the drop of the ball on the boundary between the lighting area and the non-lighting area of the cold-cathode tubes is regarded as the drop onto the lighting area.

Then, in order to obtain the illumination effect, the cold-cathode tubes in the area onto which the ball has dropped are winked for a fixed period of time, while all the cold-cathode tubes in other areas are lit up only for a fixed period of time (step S233). Consecutively, the added point is displayed on the point display section 41 and the display section 41 is winked for a fixed period of time, whereby scoring of the point is appealed (step S235).

Figure 20:
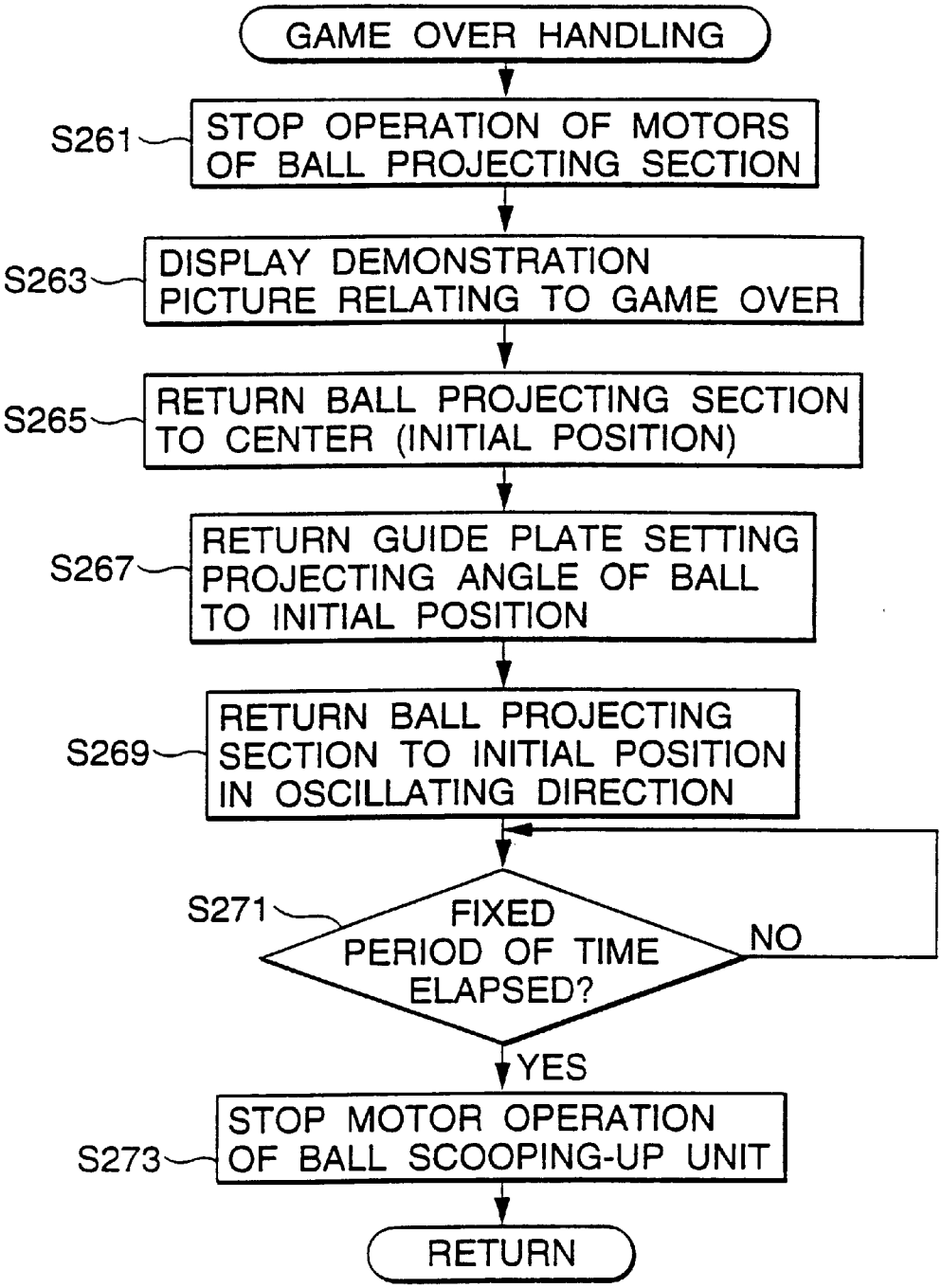
FIG. 20 is a flow chart for the explanation of game-over handling.

Game-over handling in step S57 shown in FIG. 14 will now be described with reference to the flow chart of FIG. 20.

First, the rotations of the motors in the ball projecting section 20, i.e., the hopper-inside stirring motor 234, the roller motors 253 and 254, the projecting cylinder rotating motor 263, the projecting cylinder oscillating motor 273, the guide plate motor 282 and the projecting section moving motor 96*a* are stopped (step S261), and a demonstration picture relating to game-over is displayed on the image display section 42 (step S263). The demonstration picture includes a renewal of high score, display of final score, and the like.

Then, the motor 96*a* is rotationally driven and the ball projecting section 20 is returned to the initial position, in the center of the table 10 (step S265), the motor 282 is rotationally driven and the guide plate 281 is returned to the initial position (step S267), and further, the motor 276 is rotationally driven and the ball projecting section 20 is returned to the initial position in the oscillating direction (step S269).

Thereafter, it is determined whether or not a fixed period of time has elapsed (step S271). If "yes", the rotations of the stirring/feeding motors 379 and 389 are stopped (step S273).

As described above, according to the table tennis apparatus of the present invention, it is detected which side balls projected from the ball projecting section 20 have been returned in the lateral direction, and the ball projecting section 20 is moved laterally according to the direction in which the balls have been returned. Therefore, the next ball is projected at the position near the playing surface on the player side in the direction in which the ball have been returned, a mode which is closer to actual competitive play can be realized, and the player can obtain a feeling of actually continuing a rally with a competitor. Therefore, it is possible to efficiently enhance the result of training when the table tennis apparatus of the present invention is used for training of table tennis, and game quality is increased and the apparatus becomes very interesting when used for a table tennis game.

While the present invention has been described with respect to what is presently considered to be the preferred embodiment, it is to be understood that the invention is not limited to the disclosed embodiment. To the contrary, the invention is intended to cover various modifications and equivalent arrangements included within the spirit and scope of the appended claims.

For example, it is possible to divide the playing surface 14 of the table 10 into total six areas by dividing the area near the net 16 into left-side and right-side areas. With this arrangement, even if a ball is hit into the area near the net 16, the next ball can be projected according to the area into which the ball is hit. In addition, it is possible to divide laterally the playing surface 14 into three or more areas. If the three or more areas are formed laterally on the playing surface 14 and a microphone is installed on each of the areas, the ball projection section 20 can be moved to a position closer to the ball return position, so that a competitive play which is closer to the actual play can be performed. Furthermore, cold-cathode tubes may be provided in all areas, and cold-cathode tubes of the same color may be used in the areas.

In addition, the ball projecting section 20 may be disposed rearward of the playing surface 12 on the side of a player without providing the playing surface 14. In this case, for example, it is possible to dispose a monitor rearward of the ball projecting section 20 for displaying a picture of a playing surface and a returned ball, to arrange laterally a number of optical sensors on the proximal side of the ball projecting section 20, and to detect the ball return direction according to which optical sensor the ball returned by the player passes through to thereby move laterally the ball projecting section 20 according to the result of the detection. It is also possible to dispose longitudinally a board having a plurality of through holes formed therein in the form of a matrix in place of the playing surface 14, to detect which through hole the returned ball passes through by optical sensors or mechanical switches so as to obtain the ball return direction thereby to move laterally the ball projecting section 20 according to the return direction.

Furthermore, a lamp such as a cold-cathode tube may be disposed in the first area El. In addition, it is possible to use lamps of the same luminary color. A variation of a luminary color in each of the areas can be realized by using a white-luminary lamp and a colored plate body 142. Furthermore, it is possible to constitute a surface illuminant by burying a plurality of light emitting diodes in the form of a matrix in the plate body 142 or the like. While the surface illuminant constitutes identifying means for identifying the areas of the playing surface, the identifying means can be constituted by other means such as lighting for illuminating the playing surface 14 from above.

Still furthermore, the ball sorting section may include only the rails 321 of the left collecting part 32 and the rails 331 of the rear collecting part 33, or may include only the rails 351 of the longitudinal collecting part 35 and the rails 361 of the lateral collecting part 36.

When the ball sorting section includes only the rails 321 and the rails 331, balls that have rolled to the downstream of the rails 331 may be returned towards the ball projecting section 20 by the ball scooping-up unit 38. When the ball sorting section includes only the rails 351 and the rails 361, balls that have dropped around the table 10 may be collected, for example, to the rearward of the table 10 on the floor below the table 10, and the collected balls may be transferred onto the rails 351.

Yet furthermore, the ball sorting section may only include either of the rails 321 or the rails 331, or either of the rails 351 or the rails 361. In these cases, balls that have dropped around the table 10 may be collected by suitable means, and may be transferred onto the rails of the ball sorting section. In addition, the rails may be disposed horizontally so that the balls are rolled by wind pressure.

In addition, it is possible to construct the right collecting part 34 similar to the left collecting part 32. It is also possible for the left collecting part 32 to include the same plate as that of the right collecting part 34. In this case, balls that have rolled towards the downstream of the plate may be delivered to the rails 331 of the rear collecting part 33.

Furthermore, the floor collecting part 31 may be extended to the rearward of the table 10, and the balls that have been collected in the floor collecting part 31 may be transferred to the ball sorting section from the extended portion. In addition, the floor collecting part 31 may allows the balls to be rolled by window pressure or the like.

Still furthermore, in the described embodiment, the bounded ball addition disabling unit 824 prevents a signal detected by detection means from being incorporated into the score adding unit 816 when a ball bounds to drop again on the playing surface 14. However, when addition resulting from the first drop of the ball is executed, the addition may be prevented from being executed by, for example, electrically shutting off a circuit of the detection means for a fixed period of time to disable the detecting operation.

What is claimed is:

1. A table tennis apparatus, comprising:

a ball projecting section disposed rearward of a table for projecting balls towards a playing surface on the side of a player;

a moving mechanism for moving said ball projecting section in a lateral direction of said table tennis apparatus, said moving mechanism including a guide rail disposed along the lateral direction and a base having said ball projecting section mounted thereon and slidably disposed on said guide rail;

a detecting unit for detecting which side the balls have been returned in the lateral direction; and a driving and controlling unit for driving said moving mechanism according to the direction detected by said detecting unit in which the balls have been returned, and for moving said ball projecting section to the side where the balls have been returned.

2. A table tennis according to claim 1, wherein said apparatus includes a playing surface on the side of a machine, and said ball projecting section is disposed rearward of said playing surface on the side of the machine.

3. A table tennis apparatus according to claim 1, wherein said driving and controlling unit allows said ball projecting section to be moved in the direction of at least three predetermined positions at the center, left, and right in the lateral direction, and further wherein said driving and controlling unit includes a sensor for detecting the location of said ball projecting section on said center position.

4. A table tennis apparatus according to claim 1, wherein said ball projecting section includes an oscillating mechanism.

5. A table tennis apparatus according to claim 1, wherein said driving and controlling unit allows said ball projecting section to be moved in the direction of at least three predetermined positions at the center, left, and right in the lateral direction.

6. A table tennis apparatus according to claim 1, wherein a ball hopper is disposed above said ball projecting section, and said ball hopper and said ball projecting section are connected by a flexible tube having a diameter that is capable of having balls passed therethrough.

7. A table tennis apparatus, comprising:

a ball projecting section disposed rearward of a table for projecting balls towards a playing surface on the side of a player;

a moving mechanism for moving said ball projecting section to be moved laterally;

a detecting unit for detecting which side the balls have been returned in the lateral direction; and a driving and controlling unit for driving said moving mechanism according to the direction detected by said detecting unit in which the balls have been returned, and for moving said ball projecting section to the side where the balls have been returned, wherein said moving mechanism includes a guide rail disposed along a lateral direction, and a base having said ball projecting section mounted thereon, and slidably disposed on said guide rail.

8. A table tennis apparatus according to claim 1, wherein said driving and controlling unit allows said ball projecting section to be moved in the direction of at least three predetermined positions at the center, left, and right in the lateral direction.

9. A table tennis apparatus according to claim 1, wherein a ball hopper is disposed above said ball projecting section, and said ball hopper and said ball projecting section are connected by a flexible tube having a diameter that is capable of having balls passed therethrough.

* * * * *